US009067454B2

(12) United States Patent
Quehl

(10) Patent No.: US 9,067,454 B2
(45) Date of Patent: Jun. 30, 2015

(54) BOOK WITH AN ELASTIC STRAP BAND

(75) Inventor: Alexander Quehl, Worms (DE)

(73) Assignee: Lanybook GmbH, Worms (DE)

( * ) Notice: Subject to any disclaimer, the term of this patent is extended or adjusted under 35 U.S.C. 154(b) by 364 days.

(21) Appl. No.: 13/321,948

(22) PCT Filed: Feb. 24, 2010

(86) PCT No.: PCT/EP2010/052349

§ 371 (c)(1),
(2), (4) Date: Nov. 23, 2011

(87) PCT Pub. No.: WO2010/136226

PCT Pub. Date: Dec. 2, 2010

(65) Prior Publication Data

US 2012/0067942 A1 Mar. 22, 2012

(30) Foreign Application Priority Data

May 28, 2009 (EP) ..... 09161411

(51) Int. Cl.
*B42D 3/10* (2006.01)
*B42D 9/00* (2006.01)
(Continued)

(52) U.S. Cl.
CPC *B42D 3/10* (2013.01); *B42D 9/001* (2013.01); *B42D 9/004* (2013.01); *B42D 5/003* (2013.01); *B42D 5/042* (2013.01); *B42P 2221/06* (2013.01); *B42P 2241/04* (2013.01)

(58) Field of Classification Search
CPC ..... B42D 9/001; B42D 9/002; B42D 9/004; B42P 2241/04
USPC ..... 281/42; 116/234, 237–239
See application file for complete search history.

(56) References Cited

U.S. PATENT DOCUMENTS 308,942 A * 12/1884 Yewell ..... 116/234
773,392 A * 10/1904 Holsapple ..... 281/19.1
(Continued)

FOREIGN PATENT DOCUMENTS

DE 19730354 A1 1/1999
DE 203 00 458 U1 2/2004
(Continued)

OTHER PUBLICATIONS

International Search Report for PCT/EP2010/052349 dated Dec. 3, 2010.
(Continued)

*Primary Examiner* — Kyle Grabowski
(74) *Attorney, Agent, or Firm* — Medley, Behrens & Lewis LLC; Lorri W. Cooper

(57) ABSTRACT

The present invention relates to a cover which comprises a front cover portion (1), a back cover portion (2), and an elastic strap band (3) being attached to the back cover portion (2), wherein the elastic strap band (3) is configured to be wrapped around the front cover portion (1) for keeping the cover (6) closed, the elastic strap band (3) is stretched at a predetermined stretching factor, when being wrapped around the front cover portion (1) for keeping the cover (6) closed, and the elastic strap band (3) is configured to be further stretched for releasing the front cover portion (1) so that the cover (6) can be opened. According to the invention, an image (4) is disposed on the elastic strap band (3) so as to be stretched with the elastic strap band (3), wherein the image (4) has a predetermined shape, when the elastic strap band (3) is stretched at the predetermined stretching factor and/or a movable member (7) is attached to the elastic strap band (3), wherein the movable member (7) is configured to be movable along the elastic strap band (3).

15 Claims, 18 Drawing Sheets

(51) Int. Cl.

| | |
|---|---|
| *B42D 5/00* | (2006.01) |
| *B42D 5/04* | (2006.01) |

(56) References Cited

U.S. PATENT DOCUMENTS

| | | | | |
|---|---|---|---|---|
| 4,499,741 | A | 2/1985 | Harris | |
| 5,054,816 | A * | 10/1991 | Rosengarten | 281/42 |
| 5,823,012 | A | 10/1998 | Hacskaylo | |
| 6,230,878 | B1 * | 5/2001 | Lehr | 206/37 |
| 2004/0084270 | A1 | 5/2004 | Chang | |
| 2005/0225074 | A1 * | 10/2005 | Goldberg et al. | 281/42 |
| 2007/0114783 | A1 * | 5/2007 | Glosh et al. | 281/42 |
| 2007/0183839 | A1 | 8/2007 | Walker et al. | |
| 2007/0269257 | A1 | 11/2007 | Regala | |

FOREIGN PATENT DOCUMENTS

| | | | |
|---|---|---|---|
| EP | 0142064 | A2 | 5/1985 |
| FR | 868238 | | 12/1941 |
| GB | 2451669 | * | 2/2009 |
| RU | 2135365 | C1 | 8/1999 |

OTHER PUBLICATIONS

Article 94(3) EPC communication in connection with EP application No. 13 159 726.2-1662 (corresponding EP application), dated Mar. 21, 2014.

Russian Office Action, FIIP, 2011153774/12(080874), Apr. 11, 2014, 8 pages (corresponding application).

Mexican Office Action received in corresponding Mexican Case No. MX/a/2011/012635, dated Mar. 25, 2014, including summary of Office Action in English (Letter from Alejandro Gonzalez Rossi to Wolfgang Reichl, dated Apr. 21, 2014), 7 pages.

EP Communication of Notice of Opposition, dated Apr. 29, 2014 and Opposition filed on Mar. 19, 2014, 21 pages (Opposition in German) (No English translation provided).

D6 & D6a: Veroffentlichung von Ballonpoints.com (siehe Anlage) and Foto vom Bedrucken eines aufgeblasenen Ballons (All in German) ("Publication of Ballonpoints.com (see Appendix) and photo printing from an inflated balloon"), 7 pages. (No English translation provided).

D7 & D7a: Veroffentlichungen von Gegenstanden mit Bildern (siehe Anlagen) ("Publications of articles with images having elastic objects"), depicting advertisement for Scott ski goggles with an elastic headband, 2 pages. (No English translation provided).

D8 & D8a: Veroffentlichungen von Gegenstanden mit Bildern (siehe Anlagen) ("Publications of articles with images having elastic objects"), depicting Alpina brand ski goggles with an elastic headband, 2 pages. (No English translation provided).

D9 & D9a: Veroffentlichungen von Gegenstanden mit Bildern (siehe Anlagen) ("Publications of articles with images having elastic objects"), depicting a Sigma brand head lamp having an adjustable elastic band, 2 pages. (No English translation provided).

D10 & D10a: Veroffentlichungen von Gegenstanden mit Bildern (siehe Anlagen) ("Publications of articles with images having elastic objects"), depicting a LiteXpress brand head lamp having an adjustable elastic band, 2 pages. (No English translation provided).

D11 & D11a: Veroffentlichungen von Gegenstanden mit Bildern (siehe Anlagen) ("Publications of articles with images having elastic objects"), depicting a Sailer brand hairband that is made of elastic, 2 pages. (No English translation provided).

D12 & D12a: Veroffentlichungen von Gegenstanden mit Bildern (siehe Anlagen) ("Publications of articles with images having elastic objects"), depicting a Puma brand hair tie that is made of elastic, 2 pages. (No English translation provided).

D13 & D13a: Veroffentlichungen von Gegenstanden mit Bildern (siehe Anlagen) ("Publications of articles with images having elastic objects"), depicting Adidas brand wrist bands having elastic, 2 pages. (No English translation provided).

D 14 & D14a: Veroffentlichungen von Gegenstanden mit Bildern (siehe Anlagen) ("Publications of articles with images having elastic objects"), depicting Adidas brand nozzle holders that include elastic straps, 2 pages. (No English translation provided).

D15 & D15a: Veroffentlichungen von Gegenstanden mit Bildern (siehe Anlagen) ("Publications of articles with images having elastic objects"), depicting Horn brand underwear having an elastic waistband, 2 pages. (No English translation provided).

D16 & D16a: Veroffentlichungen von Gegenstanden mit Bildern (siehe Anlagen) ("Publications of articles with images having elastic objects"), depicting Calvin Klein brand underwear having an elastic waist band, 2 pages. (No English translation provided).

"Office Action for Canadian Patent Application No. 2,759,024", Mailed Date: Mar. 17, 2015, 3 pages.

"Office Action for Russian Patent Application No. 2011153774/12(080874)", Mailed Date: Nov. 14, 2014, 8 pages.

Correspondence from foreign agent Gorodissky concerning Office Action for Russian Patent Application No. 2011153774/12(080874), mailed date: Feb. 27, 2015, 6 pages.

* cited by examiner

BOOK WITH AN ELASTIC STRAP BAND

FIELD OF THE INVENTION

The present invention relates to a cover for a paper document and a book or book-like object, in particular a notebook, a writing pad, a diary, a calendar or the like, comprising a front cover portion, a back cover portion, and an elastic strap band, which is attached to the back cover portion, wherein the elastic strap band is configured to be wrapped around the front cover portion for keeping the cover closed.

Furthermore, the present invention relates to a cover for a paper document and a book or book-like object, in particular a notebook, a writing pad, a diary, a calendar or the like, comprising a front cover portion, a back cover portion, and an elastic strap band, which is attached to the back cover portion of the cover, wherein the elastic strap band is configured to be wrapped around the front cover portion for keeping the cover closed, the elastic strap band is stretched to some extent, when the elastic strap band is wrapped around the front cover portion of the cover for keeping the cover closed, and the elastic strap band is configured to be stretched further for releasing the front cover portion so that the cover can be opened, when the elastic strap band is stretched further.

BACKGROUND OF THE INVENTION

From the prior art, there are known notebooks having a top cover and a bottom cover, wherein a thin strap band is provided for being wrapped around the top cover and the bottom cover of the notebook for keeping the notebook closed. The strap band is attached to the back cover and can be stretched manually for wrapping the strap band around the front cover so as to fix the front cover for keeping the book closed. By stretching the strap band again and pulling the strap band off the front cover, the front cover can be released from the elastic fixation so that the book can be opened.

SUMMARY OF THE INVENTION

According to the present invention, it is proposed a cover according to the independent claim. Preferred embodiments and features are described by the features of the dependent claims.

According to the present invention, a cover comprises a front cover portion, a back cover portion, and an elastic strap band, which is attached to the back cover portion of the cover, wherein the elastic strap band is configured to be wrapped around the front cover portion for keeping the stationary cover closed. The elastic strap band is stretched at a predetermined stretching factor, when it is wrapped around the front cover portion for keeping the cover closed, and the elastic strap band is configured to be further stretched for releasing the front cover so that the cover can be opened. The present invention relates to covers of books as well as book-like objects having at least a front and a back cover portion.

According to the present invention, the cover is characterized in that an image is disposed on the elastic strap band so as to be stretched together with the elastic strap band, when the elastic strap band is stretched, wherein the image has a predetermined shape, when the elastic strap band is stretched at the predetermined stretching factor.

Here, the term predetermined shape of the image describes a shape that corresponds to an intended shape of the image, e.g. an undistorted shape of a predetermined image. For example, images such as logos of companies have a certain defined shape which has to be reproduced in this defined shape without any distortions such as being stretched, blurred or warped. The predetermined shape of the image in the sense of the present invention means the undistorted shape, i.e. an image does substantially not have any distortions, when being reproduced in the predetermined shape, i.e. the image corresponds to the defined image without being stretched, blurred or warped in any direction.

According to the invention, there is provided an image on the elastic strap band in such a way that it will be stretched together with the elastic strap band, when the elastic strap band is stretched. The present invention provides the advantage that the image is provided on the strap band such that it has the predetermined shape, e.g. the undistorted shape according to the defined image, when the elastic strap band is substantially stretched by the predetermined stretching factor, which, according to the invention, is the particular stretching factor of the elastic strap band which occurs, when the elastic strap band is wrapped around the front cover portion of the cover for keeping the cover closed. Accordingly, when the elastic strap band is wrapped around the front cover portion of the cover for keeping the cover closed, the band is stretched according to the predetermined stretching factor and the image has the predetermined shape, e.g. the undistorted shape, according to a defined shape of the image. If, however, the strap band is released from the front cover portion for opening the cover, the elastic strap band contracts. Then, the image disposed on the strap band is compressed according to the contraction of the elastic strap band, i.e. the image will not have the predetermined shape, e.g. it will be distorted compared to the defined shape of the image. For instance, when stretching the elastic strap band, the image disposed thereon is stretched with the elastic strap band so that at least an aspect ratio of the image changes when the strap band is stretched. The predetermined shape of the image at least corresponds to the intended aspect ratio of the image, and according to the invention, the image is provided on the elastic strap band such that at least the aspect ratio of the image corresponds to the intended undistorted aspect ratio of the image, i.e. the predetermined aspect ratio, when the elastic strap band is wrapped around the cover for keeping the cover closed so that it is stretched at the predetermined stretching factor.

Accordingly, the image, which is disposed on the elastic strap band, has the predetermined shape, when the elastic strap band is stretched at the predetermined stretching factor. Therefore, the image has the intended shape, e.g. the undistorted shape according to a defined shape of the image, when the cover is kept closed by the elastic strap band, although the elastic strap band is wrapped around the front cover portion and stretched in this situation, namely, stretched at the predetermined stretching factor. The predetermined stretching factor may be chosen based on a requested or intended tension force of the elastic strap band, when being wrapped around the front cover portion for keeping the cover closed. The predetermined stretching factor may be a factor larger than 1, preferably larger or equal to 1.1 and, preferably, smaller or equal to 2 (the factors of 1.1 to 2 corresponding to an elastic strap band being stretched by 10% to 100%).

According to the invention, there is provided the advantage that no distortions of the image do occur in the situation in which the cover is kept closed by the stretched elastic strap band in that the shape of the image is adapted to the predetermined stretching factor, although the image is generally stretched together with the elastic strap band. In case the image has portions comprising text messages or is a text message, the text messages can be properly read off in the situation in which the cover is kept closed since the stretching factor of the elastic strap band in this situation, i.e. the predetermined stretching factor is accounted for according to the invention. Also images comprising pictures such as logos of companies, which generally have a specific predetermined shape according to a specific corporate identity, can be disposed on the elastic strap band so that the image has the predetermined shape when the elastic strap band is stretched at the predetermined factor and keeps the cover closed. This is especially advantageous, when the image is applied to the elastic strap band for promotional or advertising purposes.

The elastic strap band may be made in various widths and colours, and of various materials such as for example textile fabrics, polyester, PVC, leather, artificial leather, felt, nylon or the like, or combinations thereof. The length of the elastic strap band can be fixed or be adjustable.

The present invention can be applied to various kinds of covers such as covers of books such as notebooks, writing pads, diaries, calendars, address books, accounting books, albums of all sorts (e.g. for stamps, photographs, postcards), book covers, booklets, catalogues, document folders, files, book jackets, magazines, music books, note pads, jackets for papers, portfolios, scrap books or the like.

The cover can be made in various sizes, colours and shapes, and it can comprise various materials such as paper, card board, textile fabrics, polyester, PVC, leather, metal or the like. It may be opened in horizontal direction, either from left to right or from right to left, or it can be opened vertically.

According to an aspect of the present invention, the image is preferably applied to the elastic strap band by being woven into the elastic strap band and/or being printed onto the elastic strap band by transfer printing, embossed printing or silk-screen printing. Accordingly, there are provided plural possibilities to apply the image onto the elastic strap band.

According to an aspect of the present invention, the image is preferably applied to the elastic strap band in the predetermined shape, while the elastic strap band is stretched by the predetermined stretching factor. According to this aspect of the present invention, the image is advantageously applied to the elastic strap band such that the image has the predetermined shape, when the elastic strap band is stretched by the predetermined stretching factor, i.e. when the elastic strap band is wrapped around the front cover for keeping the cover closed. Accordingly, it is possible to provide an elastic strap band with an image applied thereto, which is in a non-distorted state, when the elastic strap band is wrapped around the front cover portion for keeping the cover closed.

According to another aspect of the present invention, the image is preferably applied to the elastic strap band in a shape, which is compressed in one direction depending on the predetermined stretching factor, while the elastic strap band is in an unstretched state so that the image has the predetermined shape, when the elastic strap band is stretched by the predetermined stretching factor.

The image can be applied to the elastic strap band in that the elastic strap band is stretched at the predetermined factor, when the image is applied, wherein the image is applied in the predetermined shape. Also, the image can be applied to the elastic strap band in a substantially unstretched state, wherein the image is applied to the elastic strap band in a compressed shape. Then, when being applied to the substantially unstretched elastic strap band, the shape of the image is preferably a compressed shape, which is compressed according to the following formula:

$$T_B=N_D/F_D.$$

Here, $T_B$ is the actual width of the image, when being applied, $N_D$ is the normal width of the image, i.e. the width of the image according to the predetermined shape of the image, and $F_D$ is the predetermined stretching factor. Here, the width of the image is the width of the image in the direction of the later stretching direction, i.e. a longitudinal extension of the elastic strap band. For example, if the elastic strap band is stretched at 20% when the cover is kept closed, i.e. the predetermined stretching factor is 1.2, then, the image is applied to the substantially unstretched elastic strap band in a shape having a width corresponding to the width of the image in the predetermined shape divided by the predetermined stretching factor 1.2.

Preferably, if the image is applied to the elastic strap band by being woven, the image is applied in a compressed shape according to the above formula to the elastic strap band, when being in a substantially unstretched state.

Preferably, if the image is applied to the elastic strap band by means of transfer printing, the image is applied in a compressed shape according to the above formula to the elastic strap band, when being in a substantially unstretched state or the image is applied in the predetermined shape to the elastic strap band, when being stretched at the predetermined stretching factor. The process of transfer printing provides a cost efficient method for applying the image to the elastic strap band. Furthermore, since the image is first printed onto transfer printing paper before being applied to the elastic strap band, the image can be applied with full colour and a at high resolution depending on the properties and capabilities of the printer. Accordingly, it is even possible to have an image comprising a photograph and/or text messages having a small font size, and also images having smaller details.

Preferably, if the image is applied to the elastic strap band by means of embossed printing, the image is applied in a compressed shape according to the above formula to the elastic strap band, when being in a substantially unstretched state.

Preferably, if the image is applied to the elastic strap band by means of silk-screen printing, the image is applied in a compressed shape according to the above formula to the elastic strap band, when being in a substantially unstretched state. For applying the image via silk-screen printing, an elastic printing material comprising silicon is used so that the image may be easily stretched together with the elastic strap band so as to avoid the forming of cracks within the image. Silk-screen printing further offers the advantage that the shade of colours of the image does substantially not change when the image is stretched together with the elastic strap band.

According to an aspect of the invention, the elastic strap band is preferably wrapped around the front cover portion horizontally or vertically. The elastic strap band may also be wrapped around the front cover portion diagonally. Preferably, the elastic strap band may be wrapped around the front cover portion substantially in parallel to the direction of the binding of the book, e.g. substantially vertically, when the binding of the cover corresponds to a common binding along the left-hand side of the front cover portion. The elastic strap band may also be wrapped around the front cover portion substantially perpendicular to the direction of the binding of the cover, e.g. substantially horizontally, when the binding of the cover corresponds to a common binding along the left-hand side of the front cover portion.

The elastic strap band may be attached to the inner face of the back cover portion so as to be wrapped around the front cover portion or the elastic strap band may be wrapped around the front cover portion and the back cover portion of the cover, depending on the kind of attachment of the elastic strap band, e.g. the elastic strap band may be attached to the outer face of the back cover portion so as to be wrapped around the front cover portion and the back cover portion or the elastic strap band may be attached to the inner face of the back cover portion.

According to an aspect of the invention, the image preferably comprises a picture, a text message and/or a logo comprising a picture and/or a text message. This provides the possibility to apply various different kinds of images, which can comprise text messages, pictures or even possible combinations thereof. Such images may be provided in various designs and may include logos, images, messages, text, advertisement and/or slogans.

According to an aspect of the invention, the cover is preferably a cover of a book, in particular a hard-bound book, an adhesive-bound book, a comb-bound book or ring bound book. The book may also be bound in any other of the known book binding techniques.

According to an aspect of the invention, the cover preferably is a cover of a notebook, a calendar, or a writing pad. They may also be a diary, an accounting book, an address book, an album for stamps, photographs, postcards or the like, an almanac, a booklet, a catalogue, a document folder, a magazine, a music book, a note pad, a portfolio, a scrap book, a prospectus, a paper document or the like, or also a book jacket or the like.

Furthermore, according to the present invention, a cover comprises a front cover portion, a back cover portion, and an elastic strap band, which is attached to the back cover portion of the cover. The elastic strap band is configured to be wrapped around the front cover for keeping the cover closed. According to the present invention, the cover is characterized in that a movable member is attached to the elastic strap band, wherein the movable member is configured to be movable along the elastic strap band. The movable member may be provided in a design of various possible shapes and also have images, logos, text messages, and/or pictures or the like applied on the movable member.

According to an aspect of the present invention, the movable member preferably has a slit and is preferably attached to the elastic strap band in that the elastic strap band preferably leads through the slit. The size of the slit is preferably substantially adjusted to a width of the elastic band in a substantially unstretched state so that the movable member is preferably substantially fixed, when the elastic band is in a substantially unstretched state or in a stretched state at the predetermined stretching factor, and wherein the movable member is preferably movable along the elastic strap band, when the elastic strap band is stretched or further stretched.

Accordingly, the movable member is substantially fixed to the elastic strap band, when the elastic strap band is in an unstretched state or stretched at the predetermined stretching factor, so that the movable member cannot shift along the elastic strap band on its own. However, a user of the cover can move the movable member along the elastic strap band in that the user stretches the elastic strap band or stretches the elastic strap band further so that it becomes thinner and the movable member becomes movable or easier to be moved.

According to an aspect of the present invention, the movable member preferably has a top portion and a bottom portion, wherein the slit is preferably located between the top portion and the bottom portion. Then, the slit may be provided such that the elastic strap band cannot unthread from the slit. According to this aspect of the invention, the movable member cannot come loose and be lost.

According to an aspect of the present invention, the movable member is preferably configured to be detachable from the elastic strap band in that the top portion and the bottom portion can be preferably disassembled from each other.

According to an aspect of the present invention, the bottom portion of the movable member preferably comprises a gap connected to the slit so that the movable member is preferably configured to be detachable from the elastic strap band in that the elastic strap band can be preferably removed from the slit through the gap by being manually unthreaded.

The movable member can also be further attached to the elastic strap band for example via pin, buckle, hook-and-loop, push button, or other attachment techniques.

According to an aspect of the present invention, the elastic strap band is preferably stretched by a predetermined stretching factor, when being wrapped around the front cover portion for keeping the cover closed, wherein the elastic strap band is preferably configured to be further stretched for releasing the front cover portion so that the cover can be opened, and an image is preferably disposed on the elastic band so as to be stretched with the elastic strap band, wherein the image preferably has a predetermined shape, when the elastic strap band is stretched at the predetermined stretching factor.

According to the invention, a book or book-like object comprising a cover according to one of the above described aspects is provided.

16B shows a sectional view of an example for a movable member according to the thirteenth embodiment of the present invention.

Figure 17A:
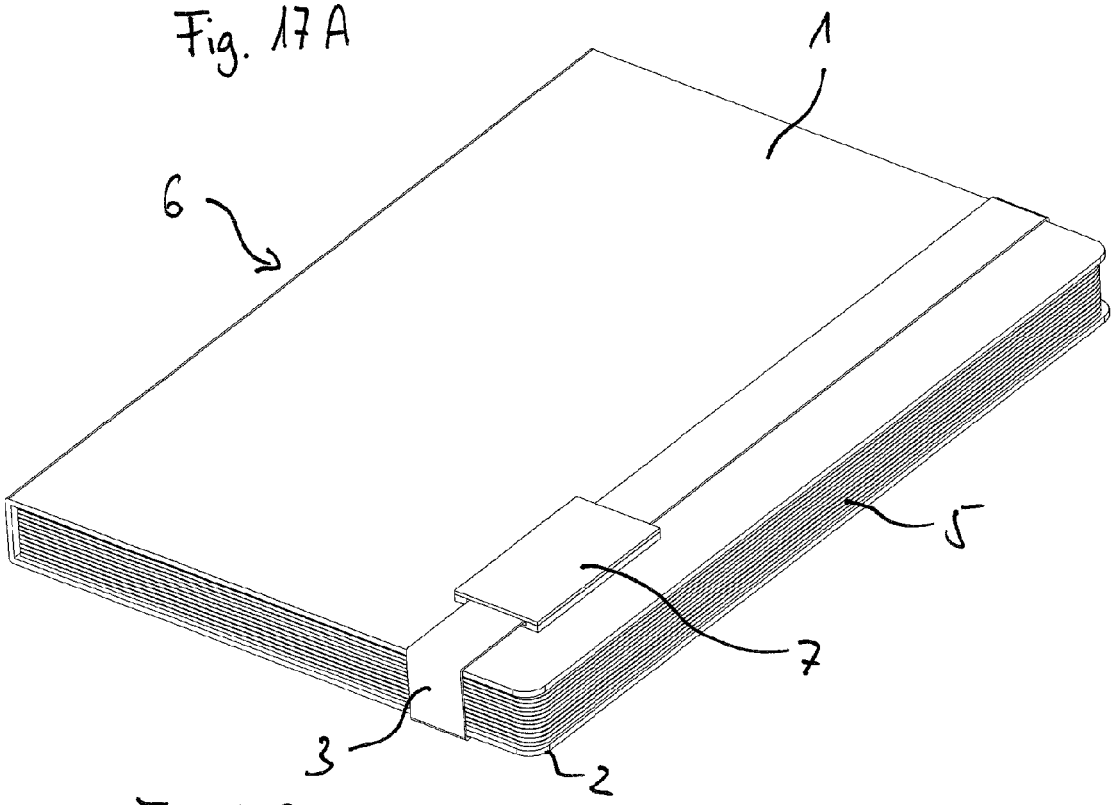
Figure 17B:
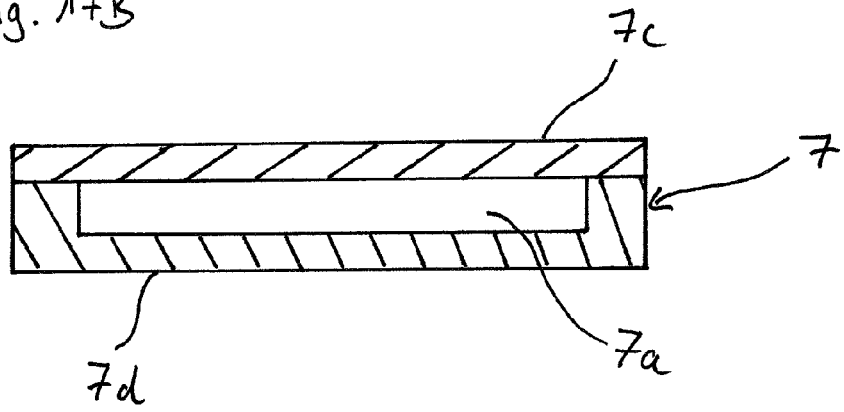

FIG. 17A shows a perspective view of a book according to a fourteenth embodiment of the present invention and FIG. 17B shows a sectional view of an example for a movable member according to the fourteenth embodiment of the present invention.

Figure 18A:
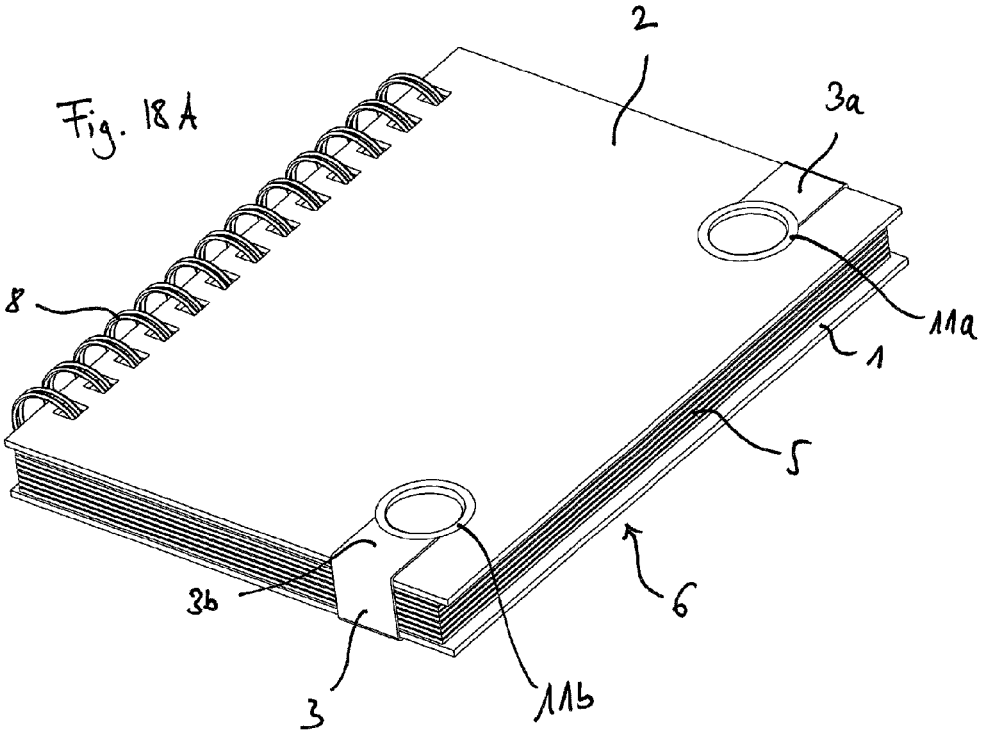
Figure 18B:
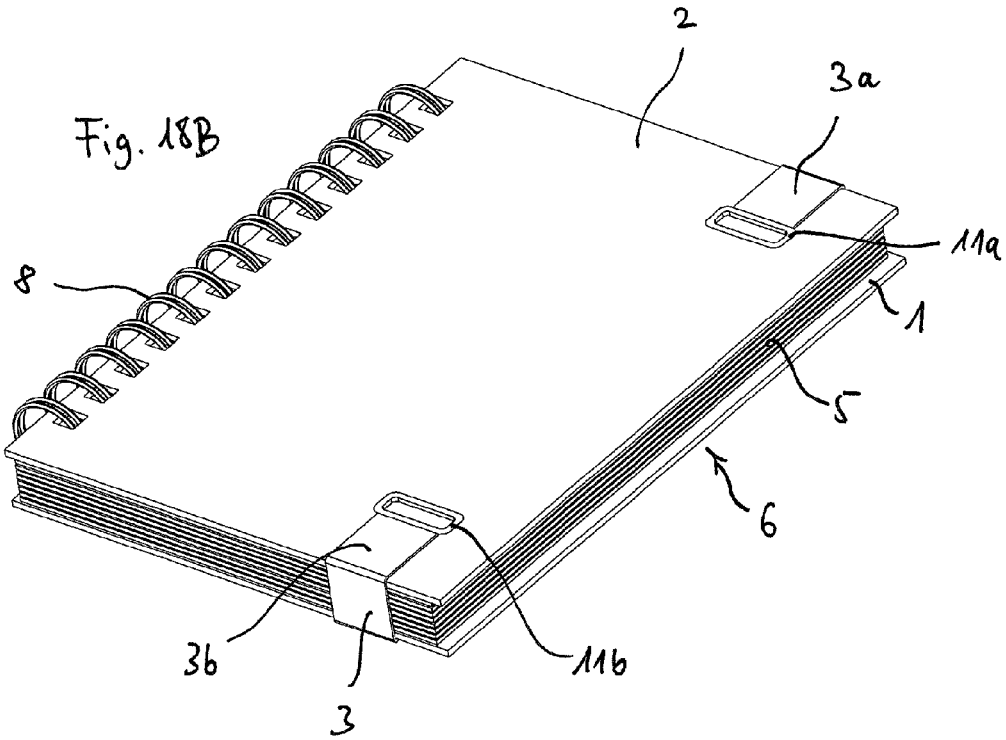

FIGS. 18A and 18B show two further examples of possible kinds of attachment of an elastic strap band to a back cover of a book according to the present invention.

Figure 19A:
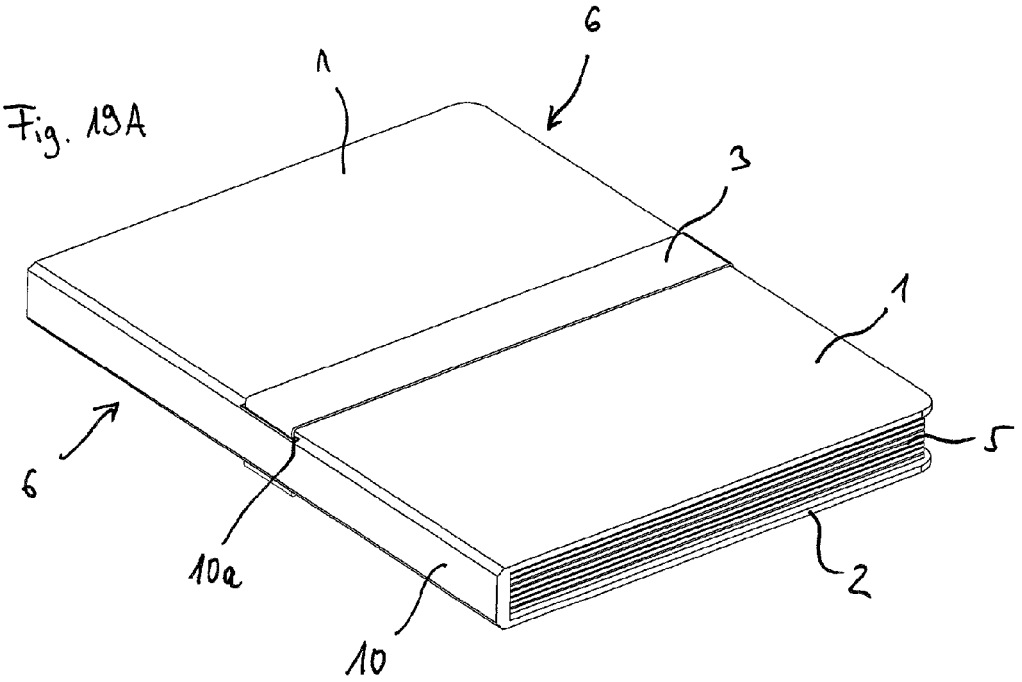
Figure 19B:
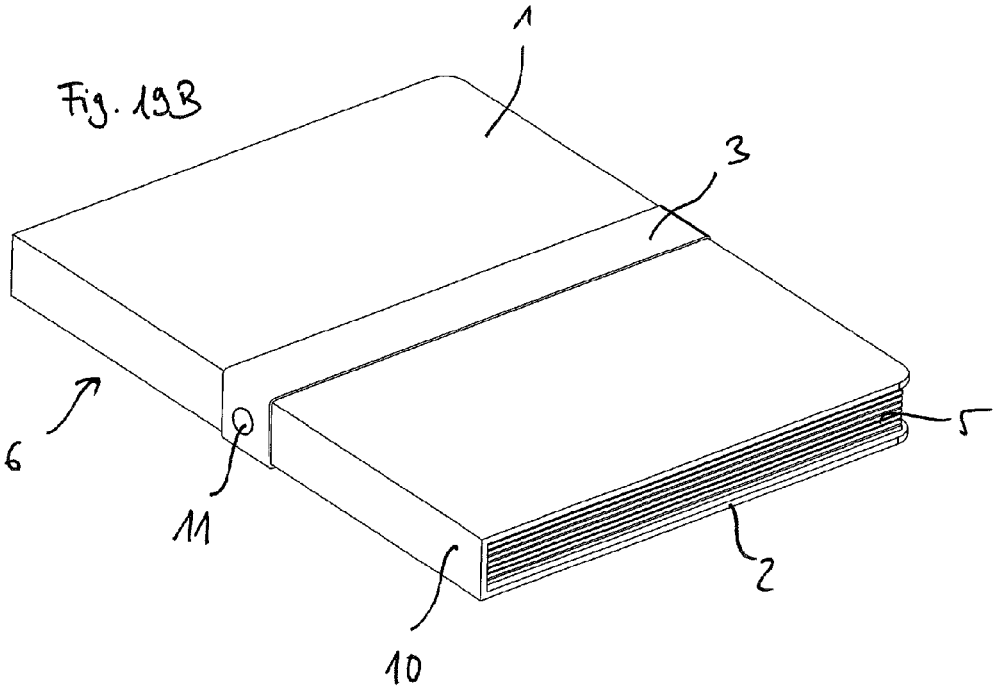

FIGS. 19A and 19B show two examples of possible kinds of attachment of an elastic strap band to a spine of a book according to the present invention.

DETAILED DESCRIPTION OF THE FIGURES AND OF PREFERRED EMBODIMENTS

Figure 1A:
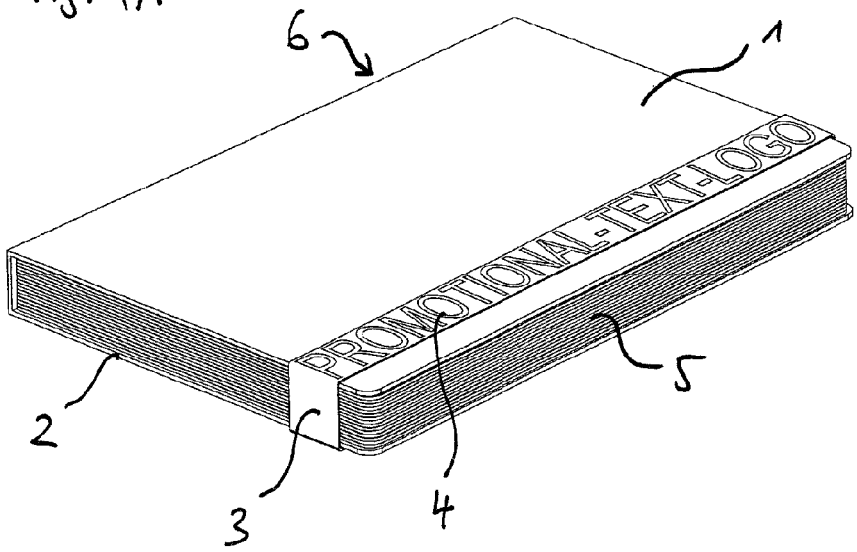
FIGS. 1A and 1B show perspective views of a book according to a first embodiment of the present invention.
Figure 1B:
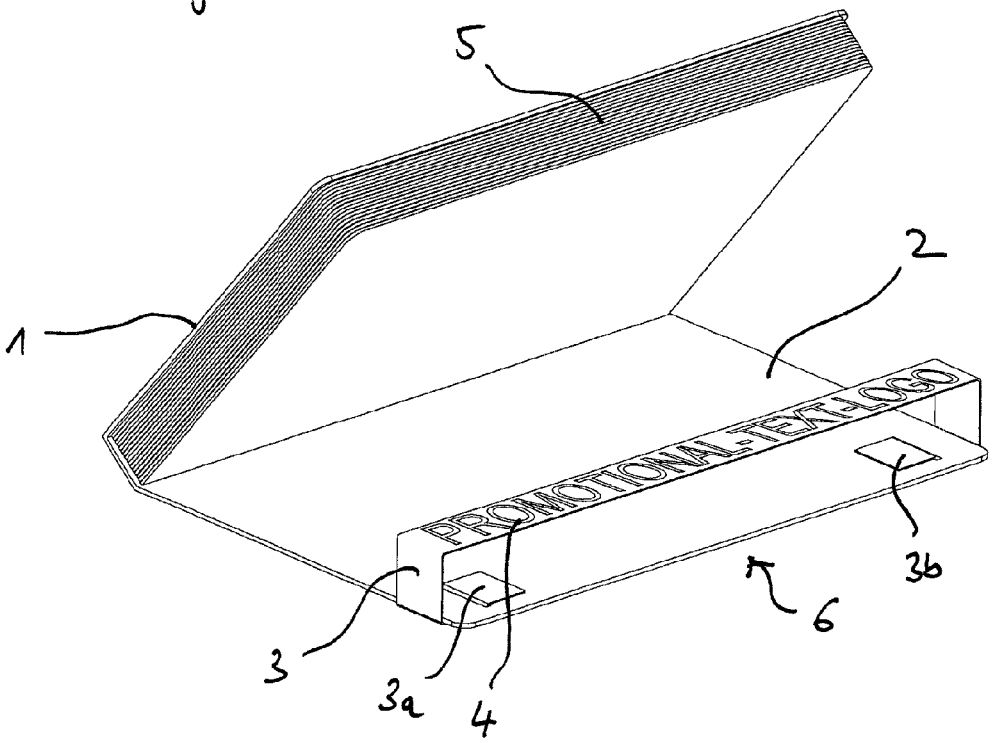

FIGS. 1A and 1B show a book 6 according to a first embodiment of the present invention. In FIG. 1A, the book 6 is shown in a closed state and in FIG. 1B, the book 6 is shown in an opened state.

According to this embodiment, the book 6 is a hard-bound book and comprises a front cover 1, a back cover 2, and book pages 5 bound by the binding of the book. However, the present invention in not limited to hard bound books and can be used also for ring-bound books, adhesive-bound books, comb-bound books, or the like.

Furthermore, the book 6 comprises an elastic strap band 3 which is attached to the back cover 2 as shown in FIG. 1B. According to this embodiment, the elastic strap band comprises two ends 3*a* and 3*b*, which are led through slits of the back cover 2 to be attached the inner face of the back cover 2, possibly adhesively attached.

An image 4 is disposed on the elastic strap band 3. According to this embodiment, the image 4 comprises a text message, however, the present invention is not limited to text messages. The image may comprise a picture, a text message and/or a logo comprising a picture and a text message.

In FIG. 1A, the book 6 is in a closed state and the elastic strap band 3 is wrapped around the back cover 2 and the front cover 1 for keeping the book 6 closed. The elastic strap band 3 in FIG. 1A is in a stretched state, wherein the stretching factor of the elastic strap band 3 in FIG. 1A corresponds to a predetermined stretching factor. In order to release the front cover 1 for opening the book 6, the elastic strap band 3 can be stretched further and pulled to the side, i.e. off of the front cover 1.

The image 4 in FIG. 1A does not exhibit any distortions since it is applied to the elastic strap band 3 such that it has a predetermined shape, when the elastic strap band 3 is wrapped around the back cover 2 and the front cover 1 as shown in FIG. 1A so as to keep the book 6 closed. Accordingly, although the image 4 is stretched together with the elastic strap band 3, i.e. it becomes distorted in the longitudinal direction of the elastic strap band 3, when the elastic strap band 3 is stretched, the image 4 does not exhibit any distortions in the state in which the elastic strap band is stretched at the predetermined factor as shown in FIG. 1A.

Figure 2A:
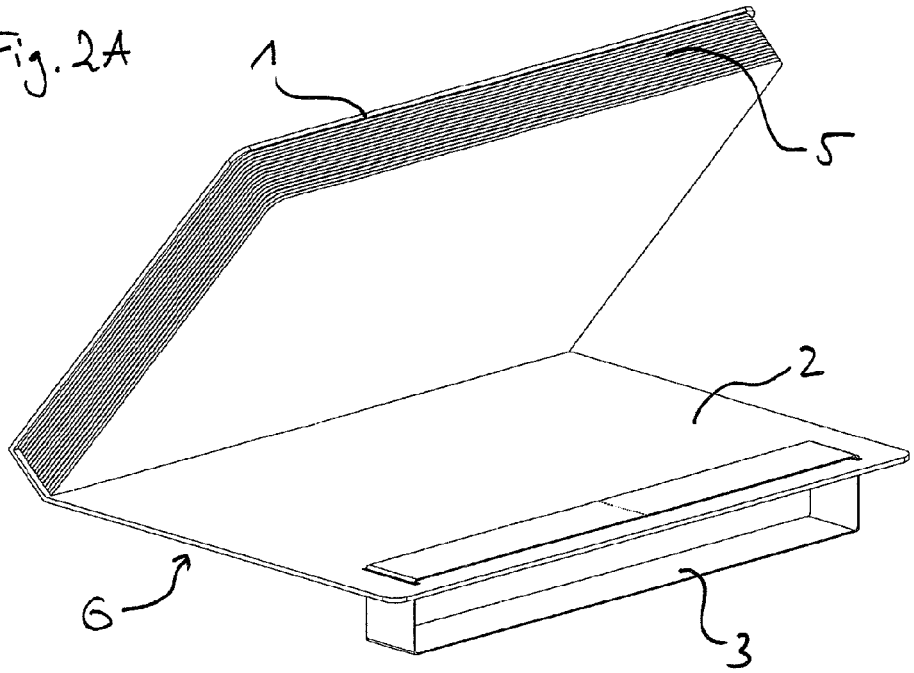
FIGS. 2A and 2B show two examples of possible kinds of attachment of an elastic strap band to a back cover of a book according to the present invention.
Figure 2B:
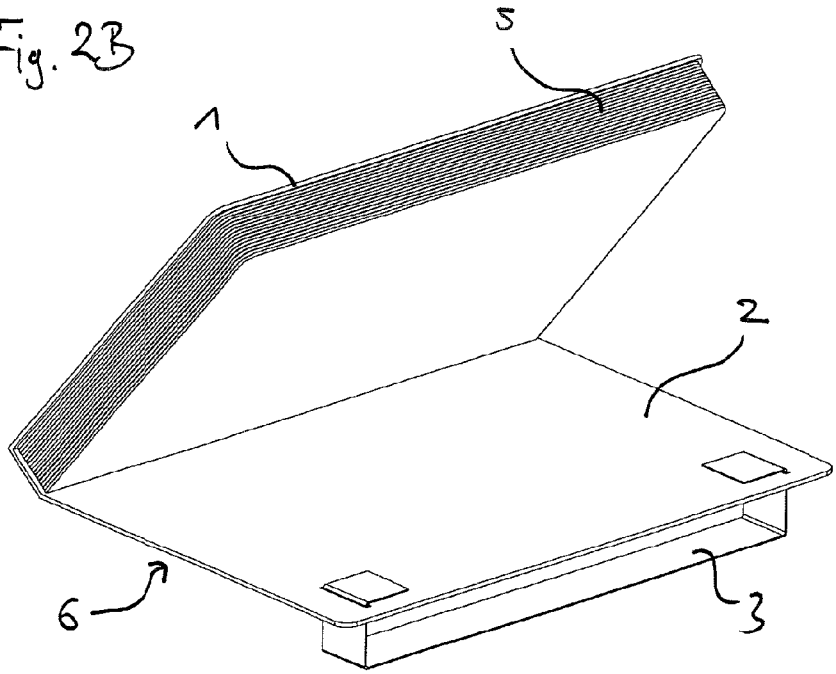

FIGS. 2A and 2B show two examples of possible kinds of attachment of an elastic strap band 3 to a back cover 2 of a book 6 according to the present invention. The kind of attachment as shown in FIG. 2A corresponds to the kind of attachment of the elastic strap band 3 of the first embodiment as shown in FIGS. 1A and 1B. Namely, the elastic strap band comprises two ends 3*a* and 3*b*, which are led through slits of the back cover 2 to be attached the inner face of the back cover 2. In FIG. 2A, the elastic strap band 3 is a loop-closed band which does not have end portions. The elastic strap band is led through two slits of the back cover 2 of the book 6 and then attached to the inner face of the back cover 2, possibly adhesively. The elastic strap band 3 can also be attached to an outer face of the back cover 2. Then, the back cover 2 is not required to comprise slits as shown in FIGS. 2A and 2B (cf. FIG. 3B).

Figure 3A:
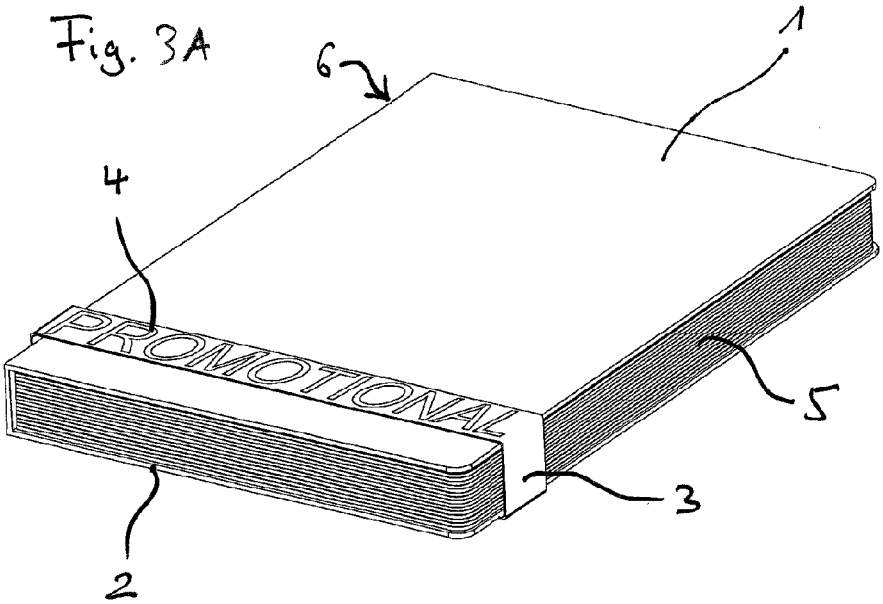
FIGS. 3A and 3B show perspective views of a book according to a second embodiment of the present invention.
Figure 3B:
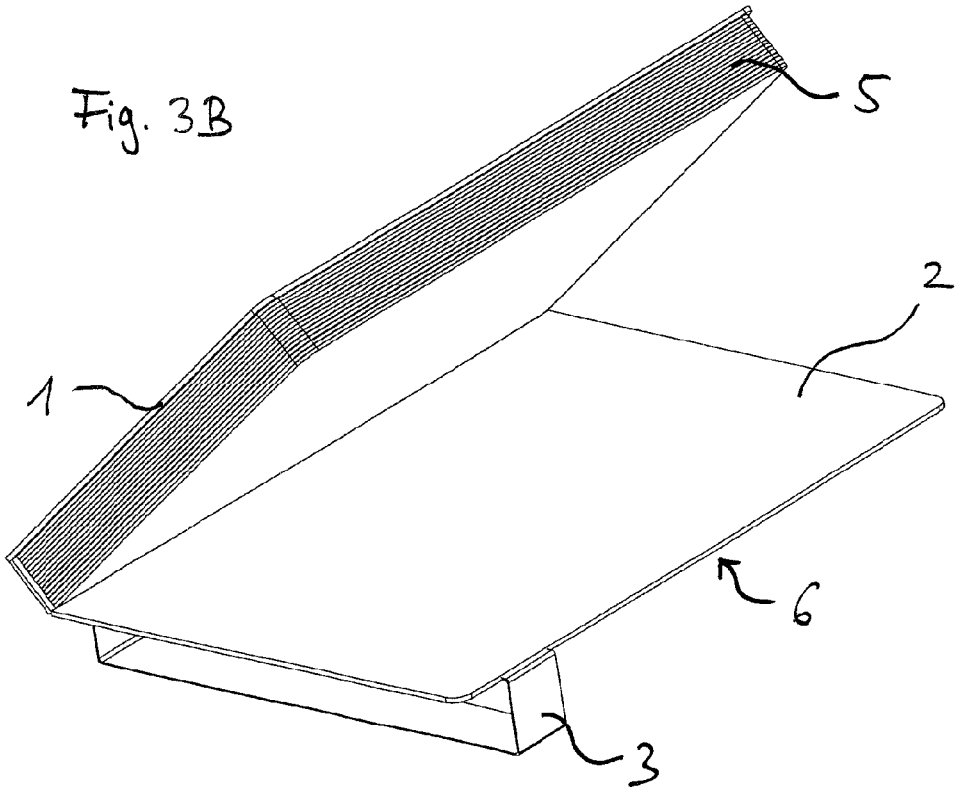

FIGS. 3A and 3B show perspective views of a book 6 according to a second embodiment of the present invention. In FIG. 3A, the book 6 is shown in a closed state and in FIG. 3B, the book 6 is shown in an opened state. The book 6 according to this embodiment comprises a front cover 1, a back cover 2, and book pages 5 between the covers 1 and 2.

Furthermore, the book 6 comprises an elastic strap band 3 which is attached to the outer face of the back cover 2 as shown in FIG. 3B. In FIG. 3A, the elastic strap band 3 is shown in the state in which it is stretched at the predetermined stretching factor, when being wrapped around the front cover 1 and the back cover 2 for keeping the book closed. Different to the first embodiment as shown in FIGS. 1A and 1B, where the elastic strap band 3 is wrapped around the book 6 substantially in parallel with the binding direction of the book 6, namely, substantially vertically for a common binding on the left-hand side of the book 6, the elastic strap band 3 is wrapped around the book 6 substantially perpendicular to the binding direction in this embodiment. Accordingly, for a common binding on the left-hand side of the book 6 as shown in FIGS. 3A and 3B, the elastic strap band 3 is wrapped around the book 6 substantially horizontally.

The image 4 in FIG. 3A does not exhibit any distortions since it is applied to the elastic strap band 3 such that it has a predetermined shape, when the elastic strap band 3 is wrapped around the back cover 2 and the front cover 1 as shown in FIG. 3A so as to keep the book 6 closed. Accordingly, although the image 4 is stretched together with the elastic strap band 3, i.e. it becomes distorted in the longitudinal direction of the elastic strap band 3, when the elastic strap band 3 is stretched, the image 4 does not exhibit any distortions in the state in which the elastic strap band is stretched at the predetermined factor as shown in FIG. 3A.

Figure 4:
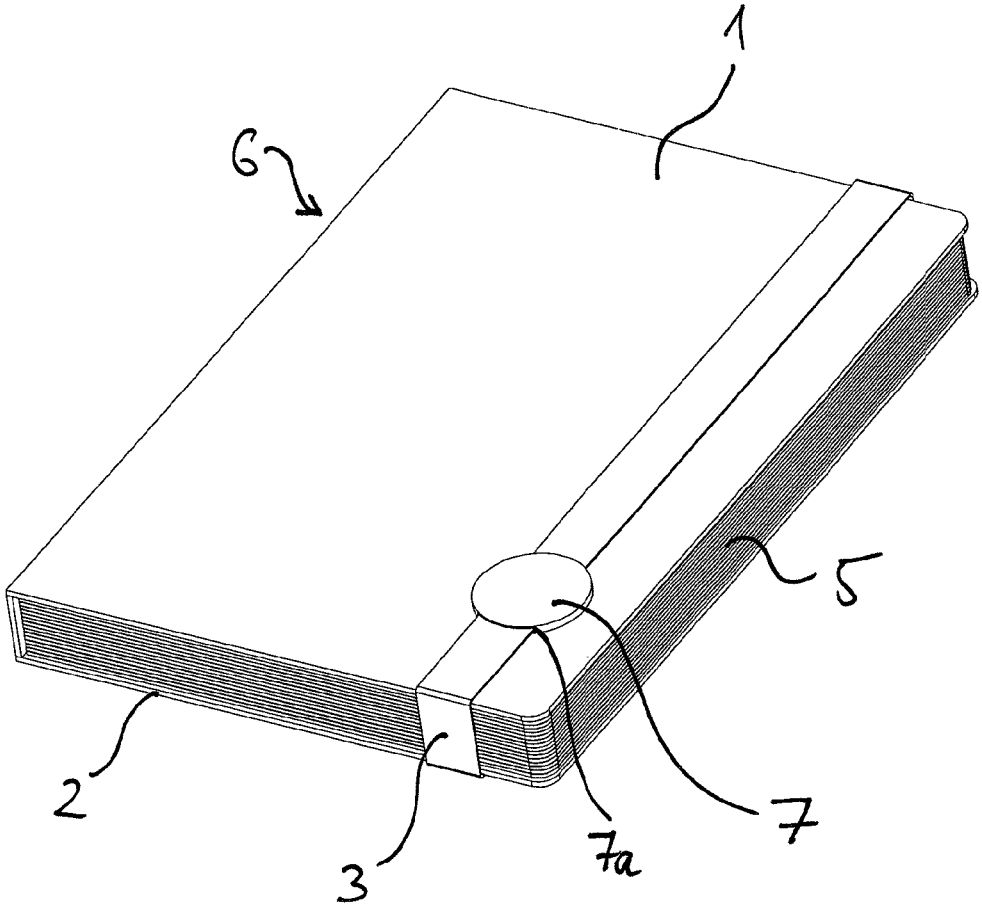
FIG. 4 shows a perspective view of a book according to a third embodiment of the present invention.

FIG. 4 shows a perspective view of a book 6 according to a third embodiment of the present invention. As in the first and second embodiment, the book 6 comprises a front cover 1, a back cover 2, and book pages 5 between the front and back covers 1 and 2. An elastic strap band 3 is wrapped around the front and back covers 1 and 2 for keeping the book 6 closed.

Furthermore, a movable member 7 is attached to the elastic strap band 3. The movable member 7 has a slit 7*a* and is attached to the elastic strap band 3 in that the elastic strap band 3 leads through the slit as shown in FIG. 4. The movable member 7 can be manually shifted along the elastic strap band 3. However, the slit 7*a* is configured such that the size of the slit 7*a* is substantially adjusted to a width of the elastic band in a substantially unstretched state or stretched at the predetermined factor. Accordingly, the movable member 7 is substantially fixed, when the elastic strap band 3 is in a substantially unstretched state or stretched at the predetermined factor so that the movable member 7 cannot shift on its own along the elastic strap band 3. However, since the elastic strap band 3 does become thinner, when being stretched or stretched further, the movable member 7 becomes movable or easier to be moved along the elastic strap band 3, when the elastic strap band 3 is stretched or further stretched.

The elastic strap band 3 in FIG. 4 does not have any image disposed thereon according to the first or second embodiment. However, the first, second and third embodiments can be combined to form further embodiments of the present invention having a movable member 7 attached to the elastic strap band and an image 4 disposed on the elastic strap band 3. Furthermore, the elastic strap band 3 may be attached to the inner face or the outer face of the back cover 2 such as for example shown in FIG. 2A, 2B or 3B.

The movable member 7 in FIG. 4 can also be assembled out of a top portion and a bottom portion so that the slit 7*a* is located between the top and the bottom portions. Then, the movable member 7 can be removed from the elastic strap band 3 in that the top portion is detached from the bottom portion.

Figure 5:
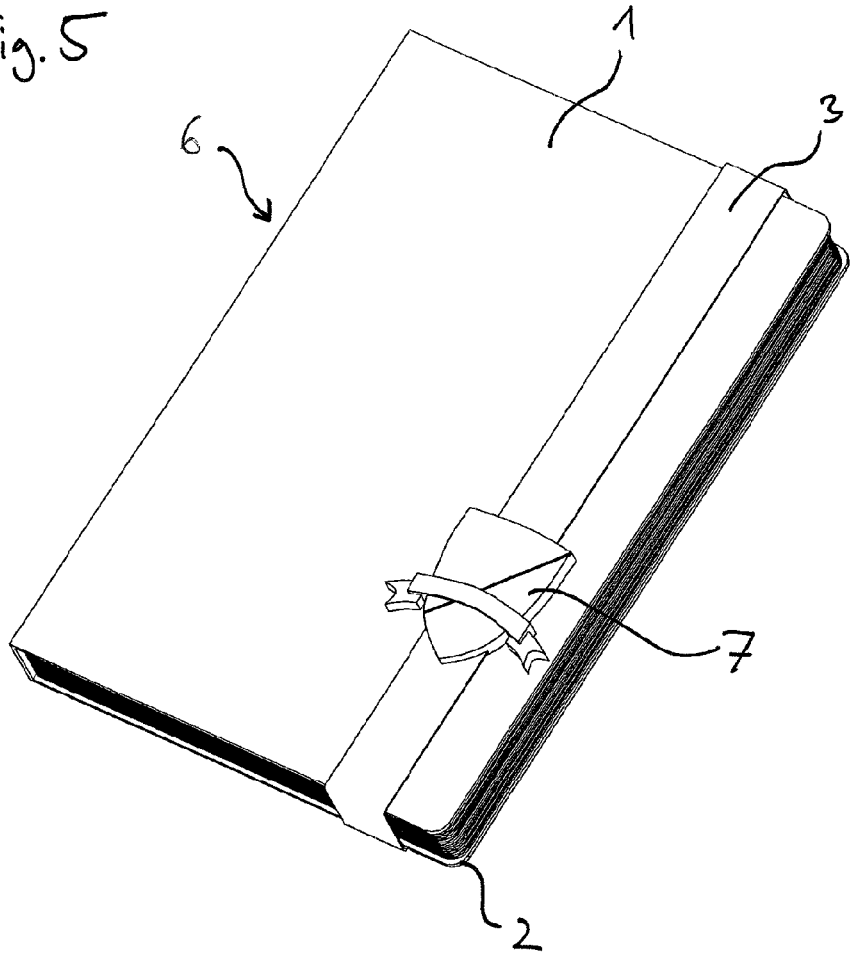
FIG. 5 shows a perspective view of a book according to a fourth embodiment of the present invention.

FIG. 5 shows a perspective view of a book 6 according to a fourth embodiment of the present invention. As in the first, second, and third embodiment, the book 6 comprises a front cover 1, a back cover 2, and book pages 5 between the front and back covers 1 and 2. An elastic strap band 3 is wrapped around the front and back covers 1 and 2 for keeping the book 6 closed.

Furthermore, as in the third embodiment, a movable member 7 is attached to the elastic strap band 3. The movable member 7 has a slit 7*a* and is attached to the elastic strap band 3 in that the elastic strap band 3 leads through the slit as shown in FIG. 5. The movable member 7 can be manually shifted along the elastic strap band 3. However, the slit 7*a* is configured such that the size of the slit 7*a* is substantially adjusted to a width of the elastic band in a substantially unstretched state or stretched at the predetermined factor. Accordingly, the movable member 7 is substantially fixed, when the elastic strap band 3 is in a substantially unstretched state or stretched at the predetermined factor so that the movable member 7 cannot shift on its own along the elastic strap band 3. However, since the elastic strap band 3 does become thinner, when being stretched or stretched further, the movable member 7 becomes movable or easier to be moved along the elastic strap band 3, when the elastic strap band 3 is stretched or further stretched.

The movable member 7 as shown in FIG. 5 can be removed from the elastic strap band 3 by being unthreaded through a gap 7*b* which is connected to the slit 7*a* so that the elastic strap band 3 can be removed from the slit 7*a* through the gap 7*b* without detaching the elastic strap band 3 from the back cover 2.

Figure 6A:
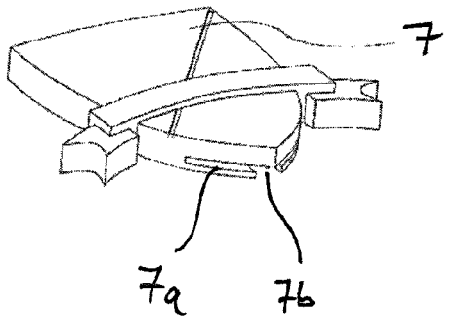
FIGS. 6A and 6B show perspective views of the movable member as shown in FIG. 5.
Figure 6B:
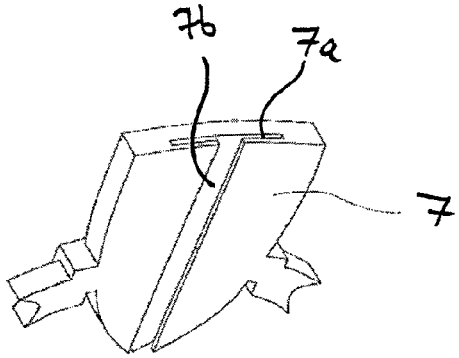

In FIGS. 6A and 6B, the movable member 7 according to this embodiment is shown in more detail. The bottom portion of the movable member 7 has the gap 7*b* through which the slit 7*a* can be reached. The gap 7*b* reaches along the whole length of the slit 7*a* from one end to another.

Figure 7A:
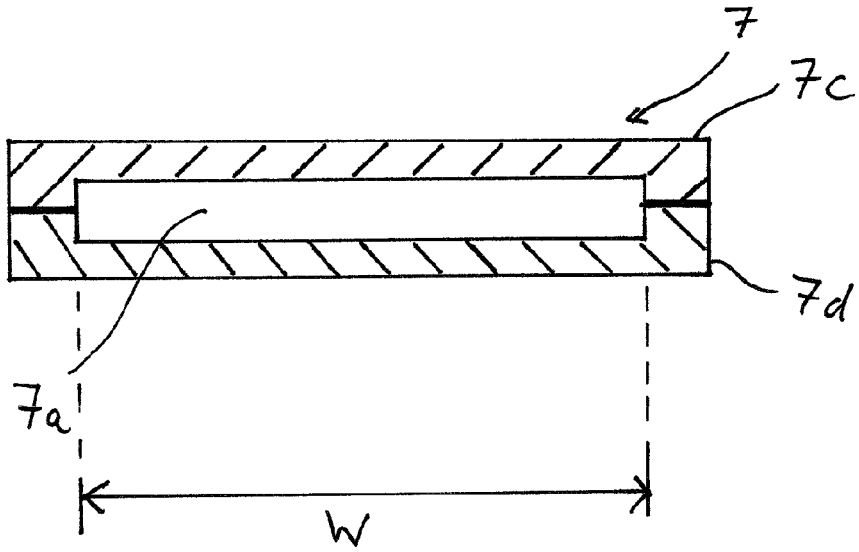
FIG. 7A shows a sectional view of an example for a movable member according to the third embodiment of the present invention and FIG. 7B shows a sectional view of an example for a movable member according to the fourth embodiment of the present invention.

FIG. 7A shows a sectional view of an example for a movable member according to the third embodiment of the present invention. The movable member 7 has a top portion 7*c* and a bottom portion 7*d*. Between the top portion 7*c* and the bottom portion 7*d*, there is provided the slit 7*a* having a width W. As can be seen from FIG. 6, the movable member 7 is attached to the elastic strap band 3 in that the elastic strap band 3 is led through the slit 7*a*.

The size of the slit 7*a*, in particular the width W of the slit 7*a*, can be substantially adjusted to a width of the elastic strap band 3 in a substantially unstretched state such that the movable member 7 is substantially fixed, i.e. it cannot shift along the longitudinal extension of the elastic strap band 3 on its own, when the elastic strap band 3 is in the substantially unstretched state, however, the movable member 7 can be manually moved along the elastic strap band 3, when the elastic strap band is stretched. The size of the slit 7*a*, in particular the width W of the slit 7*a*, can also be substantially adjusted to a width of the elastic strap band 3 in a state, where the elastic strap band 3 is substantially stretched at the predetermined stretching factor such that the movable member 7 is substantially fixed, i.e. it cannot shift along the longitudinal extension of the elastic strap band 3 on its own, when the elastic strap band 3 is stretched at the predetermined stretching factor, however, the movable member 7 can be manually moved along the elastic strap band 3, when the elastic strap band is further stretched.

The movable member 7 as shown in FIG. 7A is assembled in that the top portion 7*c* and the bottom portion 7*d* are attached to each other, wherein the movable member 7 can be configured to be detachable from the elastic strap band (3) in that the top portion 7*c* and the bottom portion 7*d* are disassembled from each other. However, the movable member 7 can also be formed as a unitary body or as a member made of multiple pieces that are fixed to each other such that the movable member cannot be disassembled.

Figure 7B:
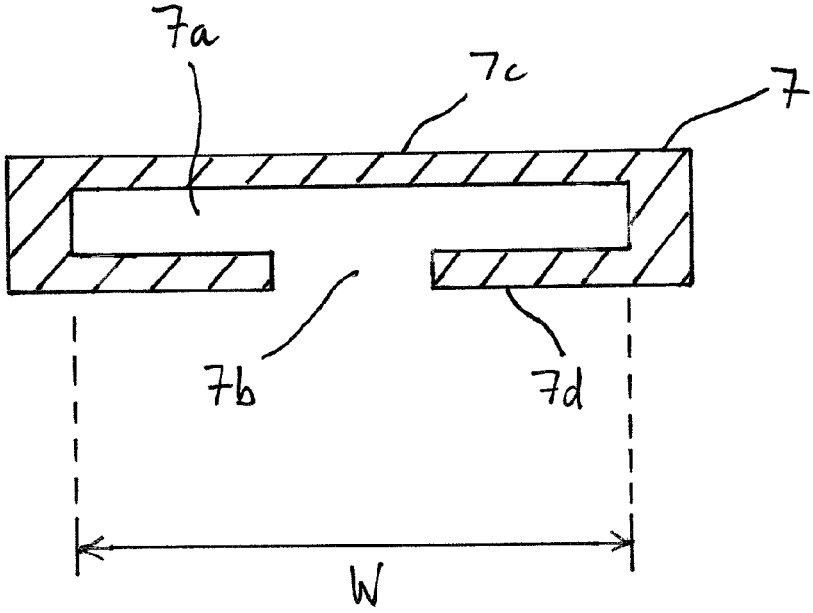

FIG. 7B shows a sectional view of an example for a movable member according to the fourth embodiment of the present invention. The bottom portion 7*d* of the movable member 7 comprises a gap 7*b* connected to the slit 7*a* such that the movable member 7 is configured to be detachable from the elastic strap band 3 in that the elastic strap band 3 can be removed from the slit 7*a* through the gap 7*b*. In FIG. 7B, the movable member 7 is formed as a unitary body, however, the present invention is not limited to movable members 7 formed as a unitary and a movable member 7 having a gap 7*b* can also be made of plural pieces.

The size of the slit 7*a* in FIG. 7B, in particular the width W of the slit 7*a*, can be substantially adjusted to a width of the elastic strap band 3 in a substantially unstretched state such that the movable member 7 is substantially fixed, i.e. it cannot shift along the longitudinal extension of the elastic strap band 3 on its own, when the elastic strap band 3 is in the substantially unstretched state, however, the movable member 7 can be manually moved along the elastic strap band 3, when the elastic strap band is stretched. The size of the slit 7*a*, in particular the width W of the slit 7*a*, can also be substantially adjusted to a width of the elastic strap band 3 in a state, where the elastic strap band 3 is substantially stretched at the predetermined stretching factor such that the movable member 7 is substantially fixed, i.e. it cannot shift along the longitudinal extension of the elastic strap band 3 on its own, when the elastic strap band 3 is stretched at the predetermined stretching factor, however, the movable member 7 can be manually moved along the elastic strap band 3, when the elastic strap band is further stretched.

Figure 8:
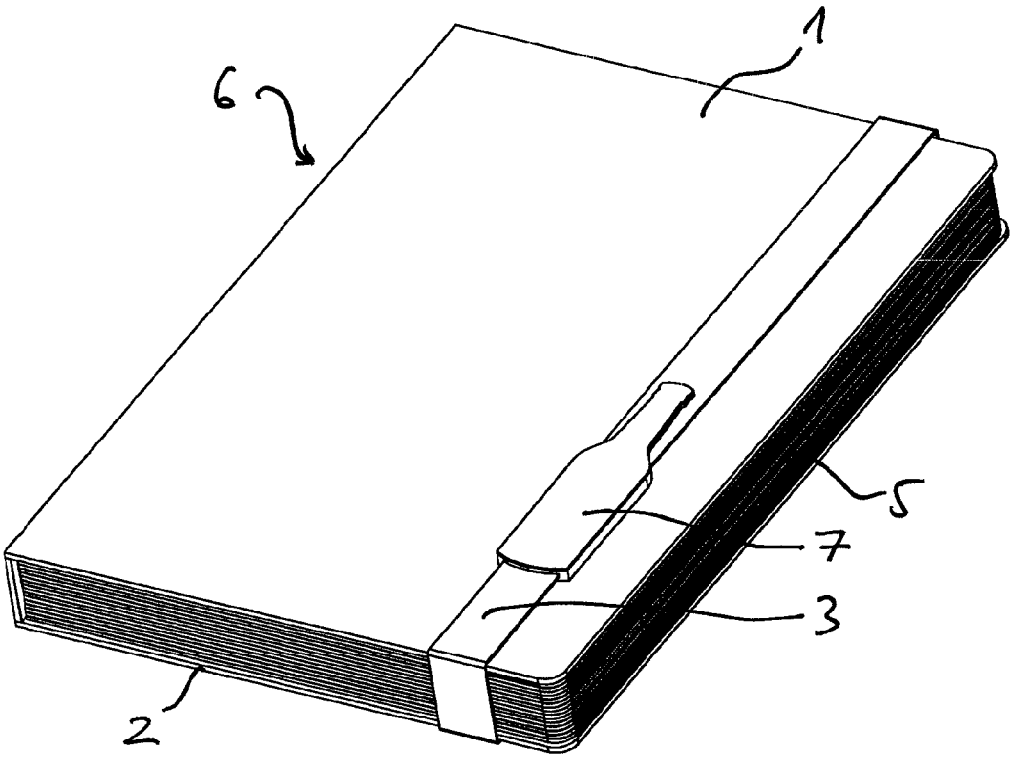
FIG. 8 shows a perspective view of a book according to a fifth embodiment of the present invention.

FIG. 8 shows a perspective view of a book according to a fifth embodiment of the present invention. This is embodiment differs from the embodiment of FIG. 4 in that the shape of the movable member 7 is different. Here, the shape of the movable member is the shape of a bottle. The movable member 7 according to the present invention can also have any other shape.

Figure 9:
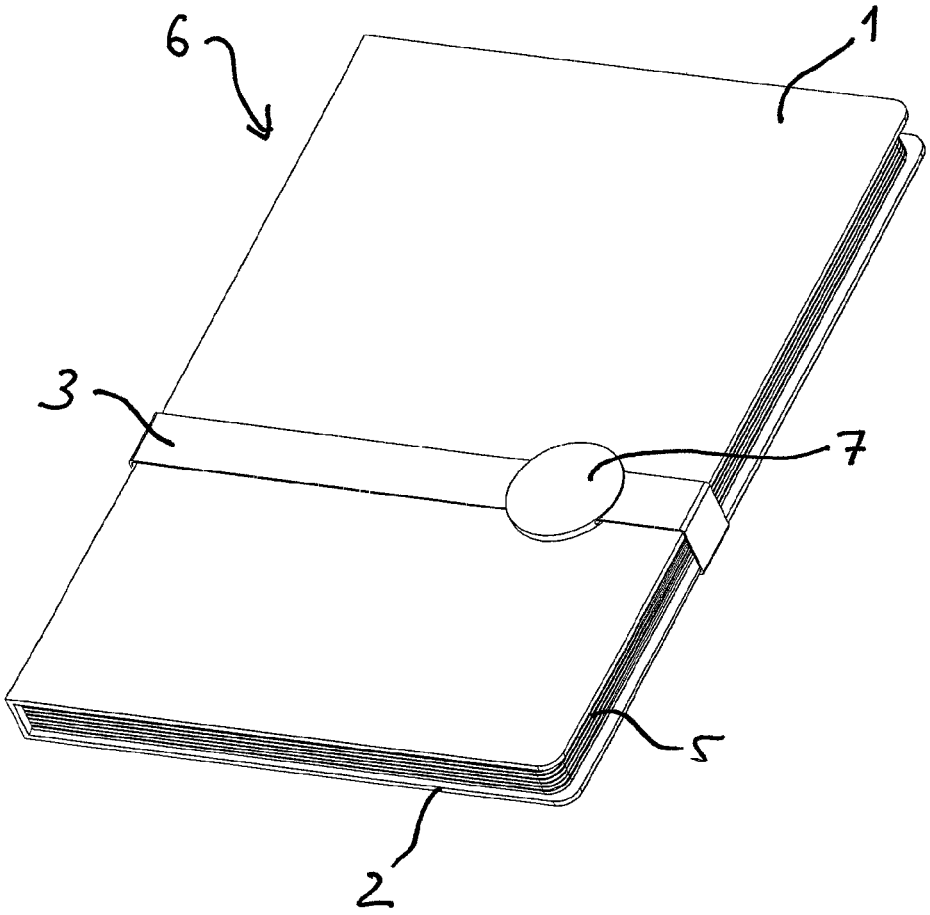
FIG. 9 shows a perspective view of a book according to a sixth embodiment of the present invention.

FIG. 9 shows a perspective view of a book according to a sixth embodiment of the present invention. This is embodiment differs from the embodiment of FIG. 4 in that the elastic strap band 3 is wrapped around the bottom cover 2 and the top cover 1 substantially perpendicular to the side of the binding of the book 6, whereas in FIG. 4, the elastic strap band 3 is wrapped around the bottom cover 2 and the top cover 1 substantially parallel to the side of the binding of the book 6.

Figure 10:
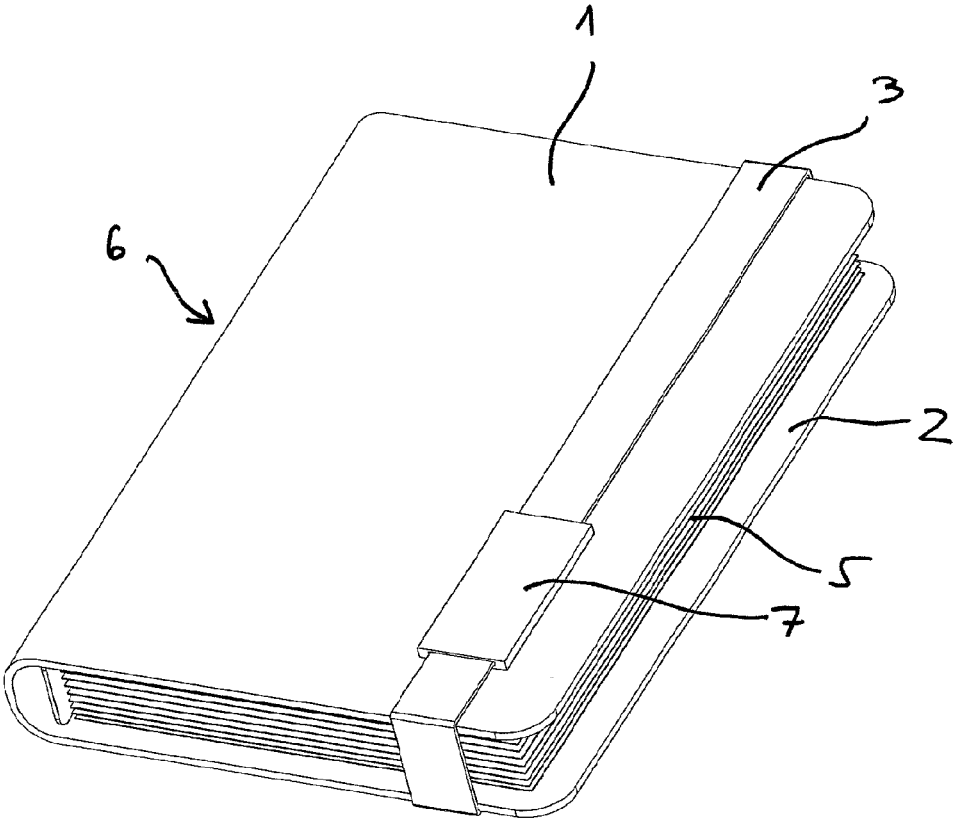
FIG. 10 shows a perspective view of a book according to a seventh embodiment of the present invention.

The above described embodiments of the present invention relate to books which are hard-bound books. However, the present invention is not limited to hard-bound books. For example, FIG. 10 shows a perspective view of a book 6 according to a seventh embodiment of the present invention. The book 6 as shown in FIG. 10 is a filofax having a jacket having a top cover 1 and a bottom cover 2. Pages 5 are disposed between the top cover 1 and the bottom cover 2. Inside the filofax 6, the pages 5 may be for example filed onto rings (not shown).

Figure 11:
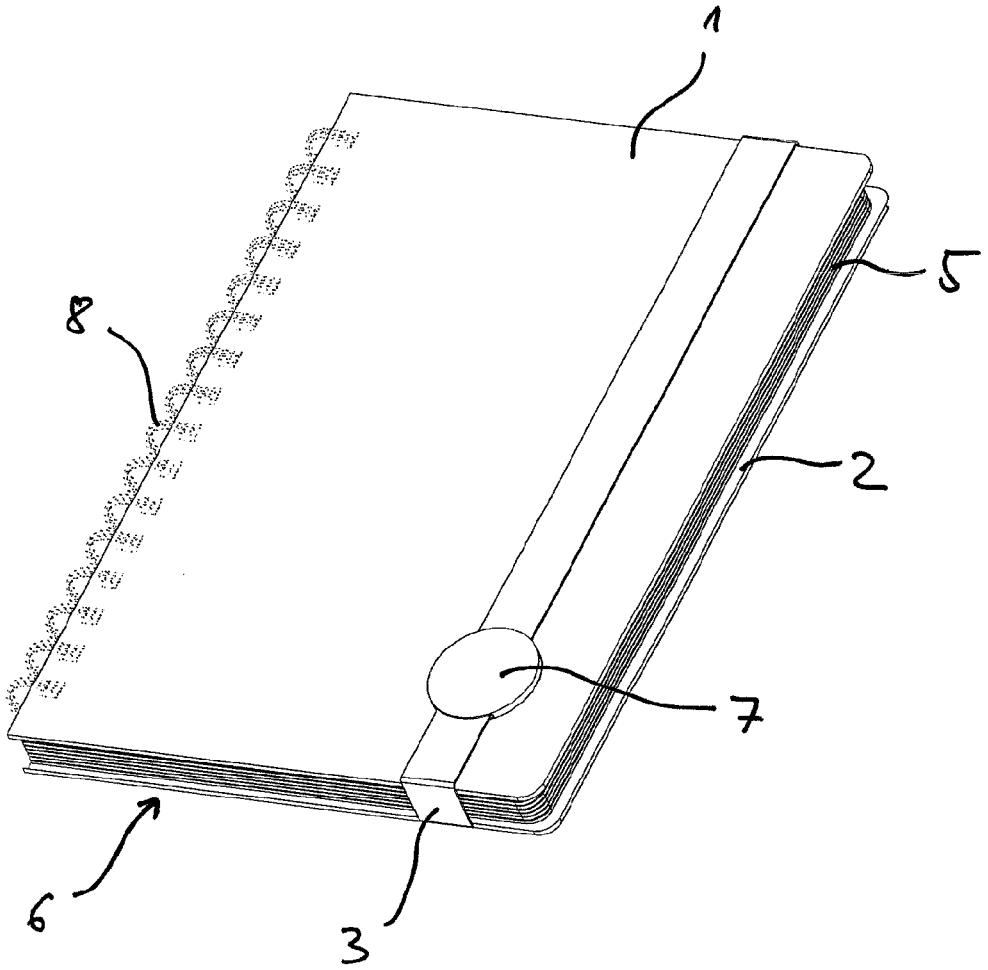
FIG. 11 shows a perspective view of a book according to an eighth embodiment of the present invention.
Figure 12:
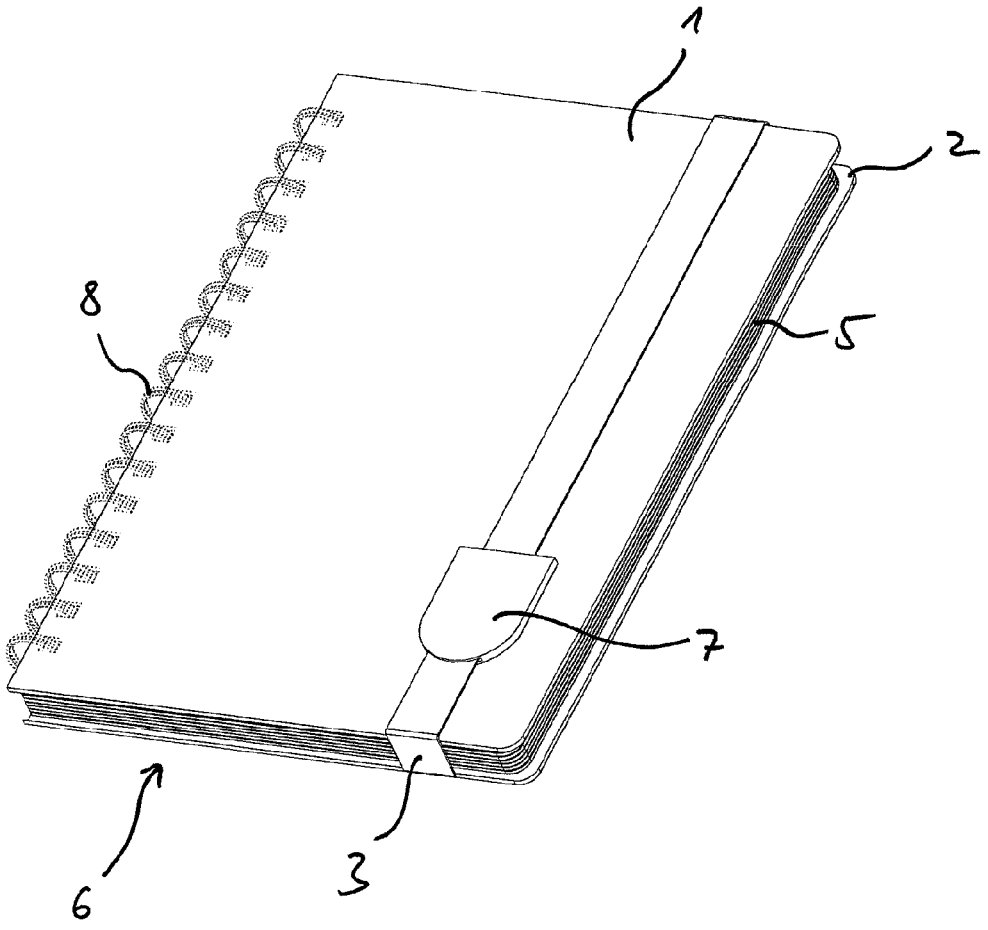
FIG. 12 shows a perspective view of a book according to a ninth embodiment of the present invention.

FIG. 11 shows a perspective view of a book according to an eighth embodiment of the present invention. The book 6 as shown in FIG. 6 differs from the book 6 as shown in FIG. 4 in that it is a ring-bound book having a ring binding 8. Also FIG. 12 shows a perspective view of a book according to a ninth embodiment of the present invention which has a ring binding 8. The only difference to the book 6 of FIG. 11 is the shape of the movable member 7.

Figure 13A:
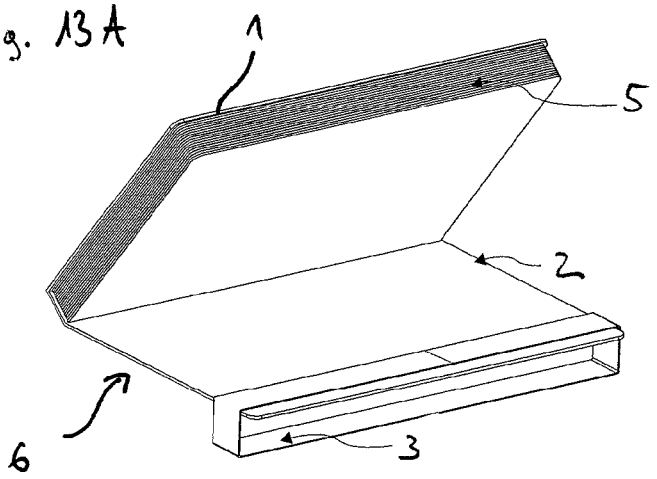
FIGS. 13A, 13B, and 13C show perspective views of a book according to a tenth embodiment of the present invention.
Figure 13B:
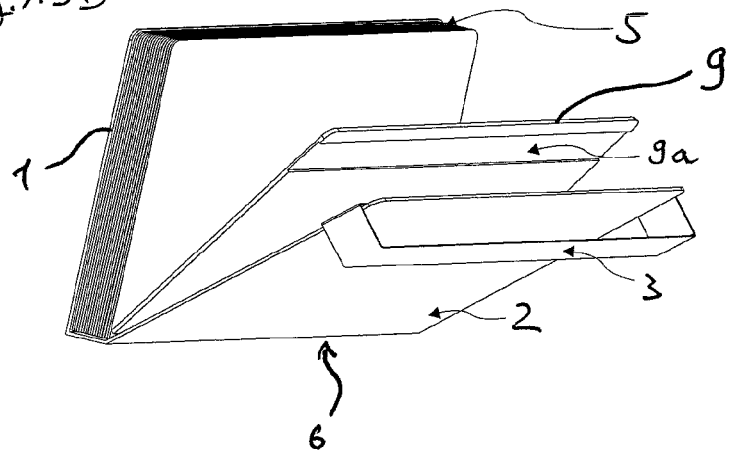
Figure 13C:
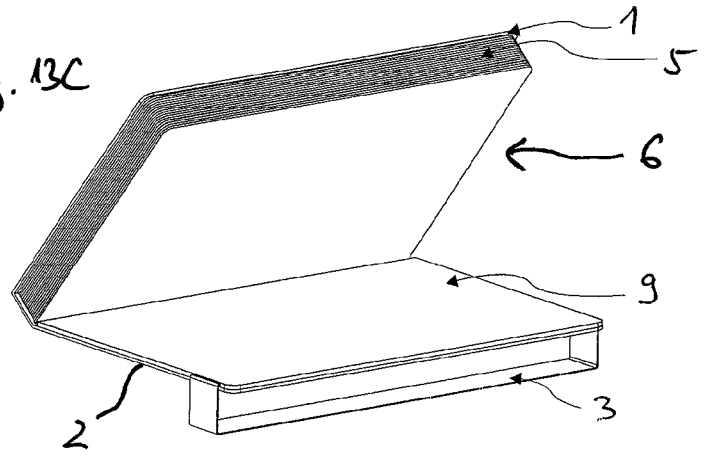

FIGS. 13A, 13B, and 13C show perspective views of a book according to a tenth embodiment of the present invention. In this embodiment, the elastic strap band is attached to the inner face of the bottom cover 2. The book 6 further comprises a intermediate cover 9 having a groove 9*a* which has a width that is adjusted to the width of the elastic strap band 3. The intermediate cover 9 can be inserted into the book 6 between the last of the pages 5 and the bottom cover 2. When the intermediate cover 9 is in contact with the bottom cover 2, the elastic strap band is accommodated within the groove 9*a* of the intermediate cover 9. The intermediate cover 9 can be attached or fixed to the bottom cover 2 e.g. adhesively, or the intermediate cover 9 can be inserted into the book 6 without fixation. When the book is closed, the elastic strap band 3 is wrapped around the intermediate cover 9 and the top cover 1, however, not around the bottom cover 2 because it is attached to the inner face of the bottom cover 1.

Figure 14A:
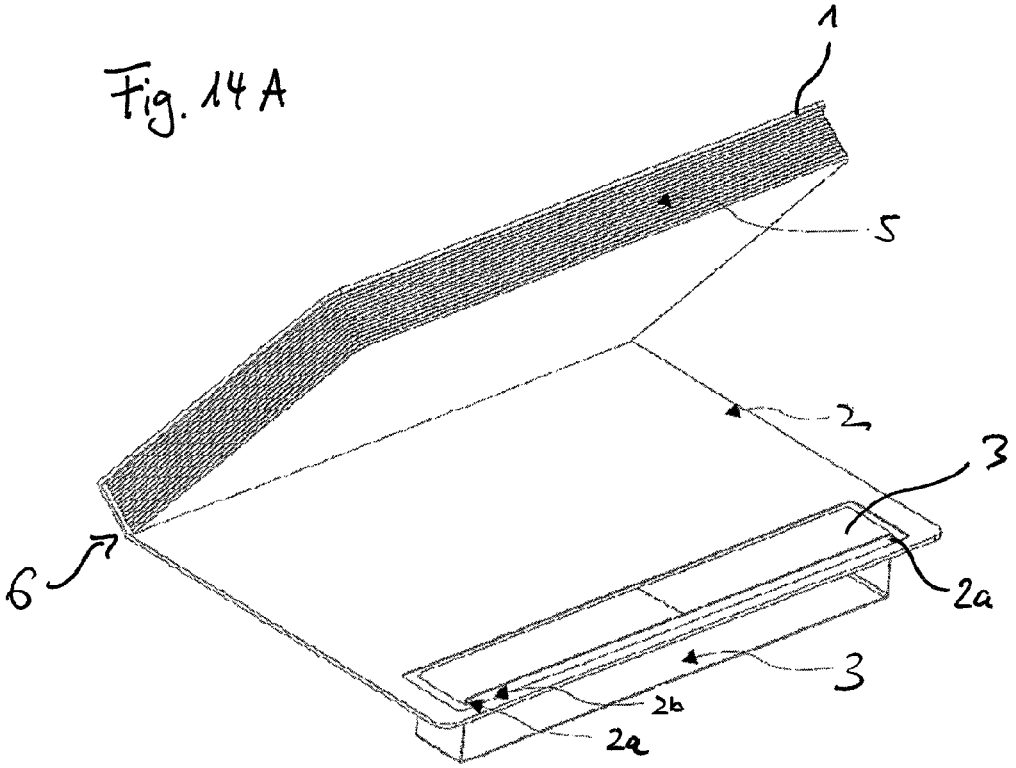
FIGS. 14A and 14B show perspective views of a book according to an eleventh embodiment of the present invention.
Figure 14B:
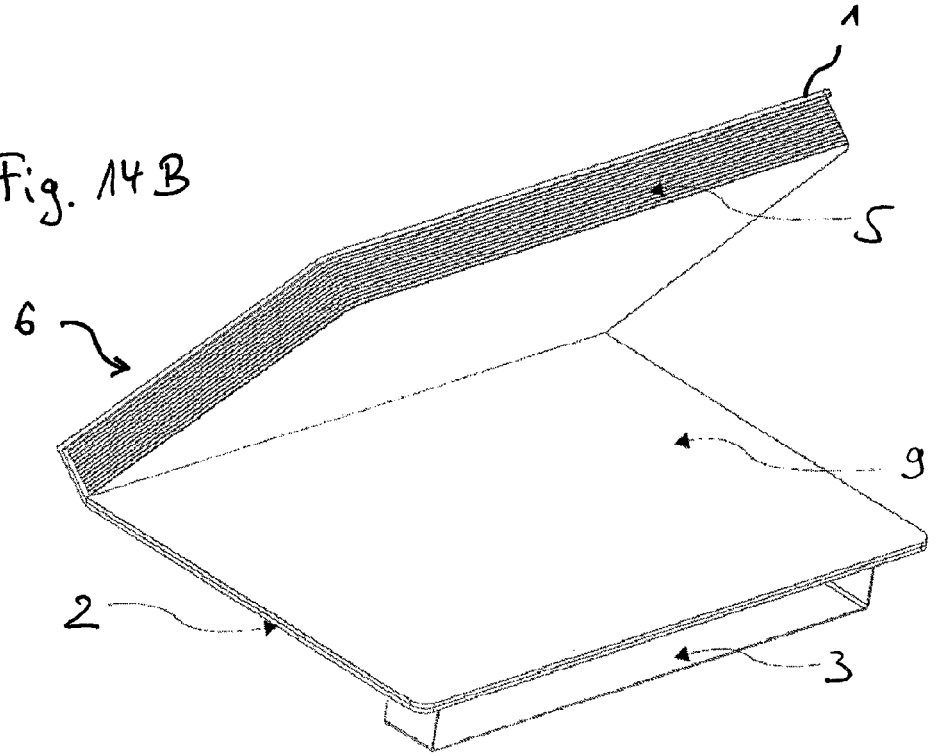

FIGS. 14A and 14B show perspective views of a book according to an eleventh embodiment of the present invention. In this embodiment, the elastic strap band 3 is attached to the cover 2 in that the elastic strap band 3 is led though slits 2*a* from the inside to the outside of the bottom cover 2 such that, when the book 6 is closed, the elastic strap band 3 is wrapped around the bottom cover 2 and the top cover 1. Furthermore, there is provided a groove 2*b* on the inner face of the bottom cover 2 for accommodating the elastic strap band 3 between the two slits 2*a*. The depth of the groove 2*b* corresponds substantially to a height of the elastic strap band 3. In addition, there is provided a plain intermediate cover 9 which is inserted between the last of the pages 5 and the bottom cover 9 for covering the groove 2*b* and, therein, also covering the elastic strap band 3.

Figure 15A:
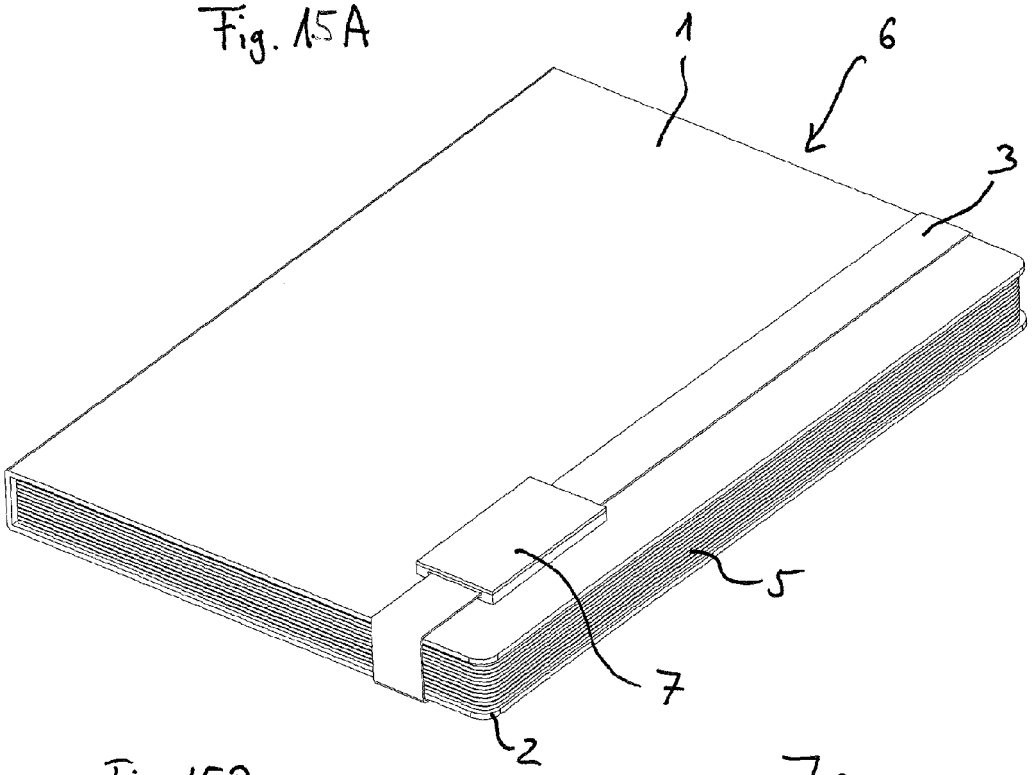
FIG. 15A shows a perspective view of a book according to a twelfth embodiment of the present invention and FIG. 15B shows a sectional view of an example for a movable member according to the twelfth embodiment of the present invention.
Figure 15B:
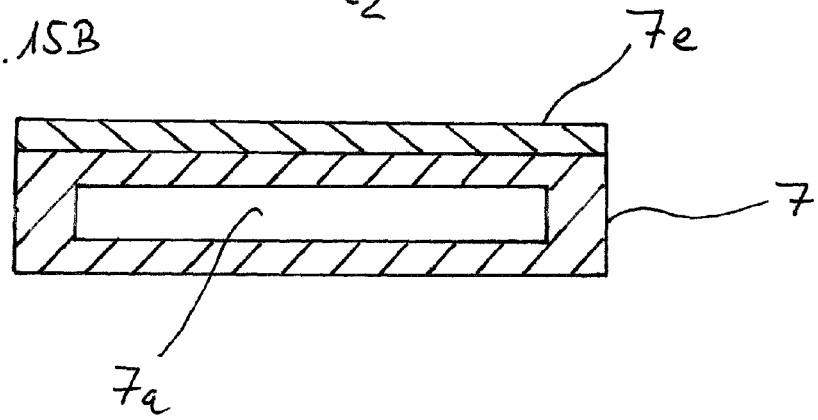

FIG. 15A shows a perspective view of a book according to a twelfth embodiment of the present invention and FIG. 15B shows a sectional view of an example for a movable member according to the twelfth embodiment of the present invention. In this embodiment, the movable member 7 is formed as a unitary body having the slit 7*a*. A top element 7*e* is disposed on the movable member 7 and attached thereto. The top element 7*e* may be made of a different material that the movable member 7 and comprise design elements such as pictures, logos, text messages or the like. For example, an image or the like comprising a picture and/or a text message can be printed onto the movable member 7, wherein the top element 7*e* can be made of a transparent material so that the image is visible from outside. The image or the like can also be disposed on the top face of the top element 7*e*.

Figure 16A:
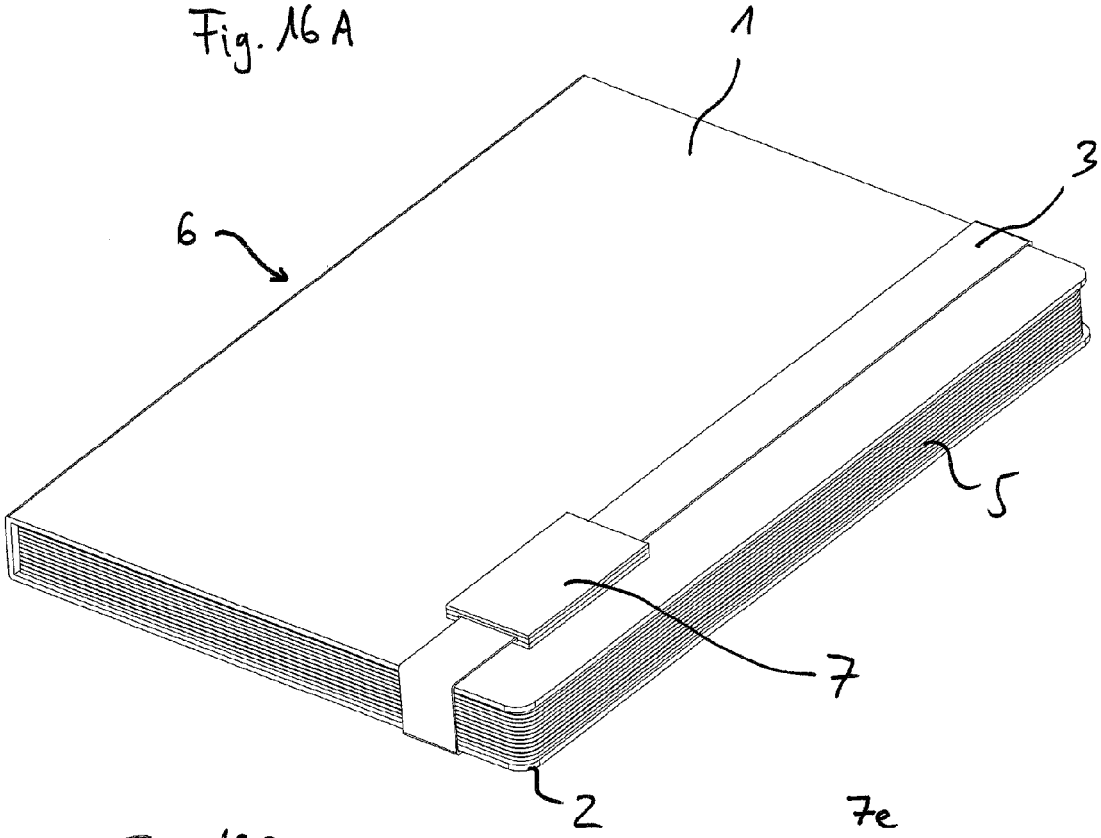
FIG. 16A shows a perspective view of a book according to a thirteenth embodiment of the present invention and FIG.
Figure 16B:
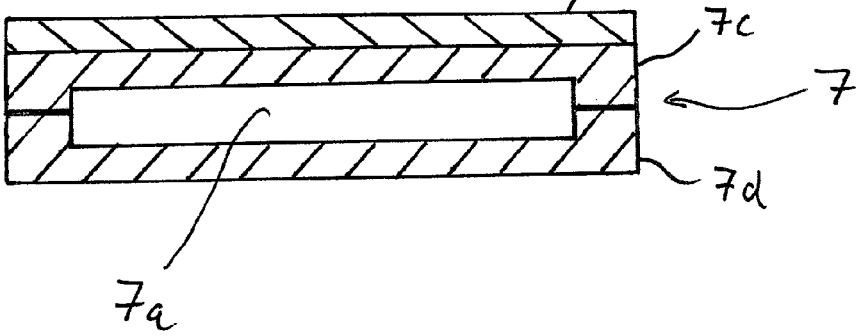

FIG. 16A shows a perspective view of a book according to a thirteenth embodiment of the present invention and FIG. 16B shows a sectional view of an example for a movable member according to the thirteenth embodiment of the present invention. This embodiment only differs from the embodiment of FIGS. 15A and 15B in that the movable member 7 is made of two pieces, one piece being the top portion 7*c* of the movable member 7 and one piece being the bottom portion 7*d* of the movable member 7, wherein the slit 7*a* is located between the top portion 7*c* and the bottom portion 7*d*. The top portion 7*c* and the bottom portion 7*c* may also be configured to be disassembled similar to the movable member 7 of FIG. 7A.

FIG. 17A shows a perspective view of a book according to a fourteenth embodiment of the present invention and FIG. 17B shows a sectional view of an example for a movable member according to the fourteenth embodiment of the present invention. In this embodiment, the top portion 7*c* of the movable member 7 has a plain cross-section and the bottom portion 7*d* of the movable member 7 has a U-shaped cross-section such that the bottom portion 7*d* has a groove that forms the slit 7. On the other hand, in the embodiments of FIGS. 7A and 16B, both portions, i.e. the bottom portion 7*d* and the top portion 7*c* have a U-shaped cross section such that they comprise grooves which form the slit 7*a*, when the top portion 7*c* and the bottom portion 7*d* are put together.

FIG. 18A shows a further example of a possible kind of attachment of an elastic strap band to a back cover of a book according to the present invention. Here, the book 6 of FIG. 18A is a ring-bound book 6 having a ring binding 8. However, this attachment of the elastic strap band 3 is not limited to embodiments having this type of binding. In the example, the elastic strap band 3 comprises two end portions 3*a* and 3*b* which are respectively attached to the back cover of the book 2 by means of ring-shaped rivet-like elements 11*a* and 11*b* which are fixed into through holes of the back cover 2. The ring-shaped rivet-like elements 11*a* and 11*b* can be made of metal. In FIG. 18B, a further example is shown, where the end portions 3*a* and 3*b* of the elastic strap band 3 are also respectively attached to the back cover 2 by means of rivet-like elements 11*a* and 11*b* having a substantially rectangular shape.

FIGS. 19A and 19B show two examples of possible kinds of attachment of an elastic strap band to a spine of a book according to the present invention. In FIG. 19A, the book 6 comprises slits 10*a* at the border between the spine 10 of the book and the covers 1 and 2. In this example, the elastic strap band 3 is attached to the book cover in that it is led through the slits 10*a*. In this example, the elastic strap band 3 is wrapped around the front cover 1 and the back cover 2 substantially perpendicular to the extension of the spine 10 of the book 6. In the example of FIG. 19B, the elastic strap band 3 is attached to the spine 10 of the book 6 in that it is fixed by means of a rivet 11. Also in this example, the elastic strap band 3 is wrapped around the front cover 1 and the back cover 2 substantially perpendicular to the extension of the spine 10 of the book 6. The slits 10*a* can be substantially adjusted to the width of the elastic strap band 3 as shown in FIG. 19A or, the slits 10*a* can have a width which is larger than the width of the elastic strap band so that the elastic strap band may be shifted along the longitudinal extension of the spine 10 of the book.

Features, components and specific details of the structures of the above-described embodiments may be exchanged or combined to form further embodiments of the present invention optimized for the respective application. As far as those modifications are readily apparent for an expert skilled in the art they shall be disclosed implicitly by the above description without specifying explicitly every possible combination, for the sake of conciseness of the present description.

The invention claimed is:

1. A cover for a paper document comprising:

a front cover portion (1), a back cover portion (2), and an elastic strap band (3) attached to the back cover portion, the elastic strap band (3) being configured to be wrapped around the front cover portion (1) for keeping the cover closed, wherein the elastic strap band (3) is stretched at a predetermined stretching factor when wrapped around the front cover portion (1) for keeping the cover closed, the elastic strap band (3) being configured to be stretched at an amount that is greater than the predetermined stretching factor for releasing the front cover portion (1) so that the cover can be opened, a movable member (7) attached to the elastic strap band (3), wherein the movable member (7) has a rectangular slit (7*a*), wherein a size of the slit (7*a*) is substantially adjusted to a width of the elastic strap band (3) in a stretched state at the predetermined stretching factor so that the movable member (7) is substantially fixed and cannot shift on its own without the application of external force when the elastic strap band (3) is in the stretched state at the predetermined stretching factor, and the movable member (7) is movable along the length of the elastic strap band (3) when the elastic strap band is stretched at an amount that is greater than the predetermined stretching factor, wherein the movable member (7) has a top portion and a bottom portion, with the slit (7*a*) being located between the top and the bottom portions, and the slit (7*a*) extends along an entire length of the movable member, wherein the bottom portion of the movable member (7) comprises a gap (7*b*) that extends along and completely through the entire length of the bottom portion and is connected to the slit (7*a*) so that the movable member (7) is configured to be detachable from the elastic strap band (3) in that the elastic strap band (3) can be removed from the slit (7*a*) via the gap (7*b*), and wherein the gap is sized to enclose the elastic strap band in the slit so that it does not contact the cover when the elastic strap band is stretched at the predetermined stretching factor.

2. The cover according to claim 1, wherein the movable member (7) is attached to the elastic strap band (3) in that the elastic strap band (3) leads through the slit (7*a*).

3. The cover according to claim 1, wherein the movable member (7) is configured to be detachable from the elastic strap band (3) in that the top portion and the bottom portion can be disassembled from each other.

4. The cover according to claim 1, wherein an image (4) is disposed on the elastic strap band (3) and the image (4) has a predetermined, intended shape when the elastic strap band (3) is stretched at the predetermined stretching factor.

5. The cover according to claim 4, wherein the image is applied to the elastic strap band comprising the step of:

applying the image (4) to the elastic strap band (3) in the predetermined, intended shape, while the elastic strap band (3) is kept stretched at the predetermined stretching factor; or applying the image (4) to the elastic strap band (3) in a shape that is compressed in one direction depending on the predetermined stretching factor while the elastic strap band (3) is kept in an unstretched state so that the image (4) has the predetermined, intended shape when the elastic strap band (3) is stretched at the predetermined stretching factor.

6. The cover according to claim 4, wherein the predetermined stretching factor is larger than 1, and, although the image (4) is stretched together with the elastic strap band (3) so that it gets distorted in a longitudinal direction when the elastic strap band (3) is stretched beyond the predetermined stretching factor, the image (4) is provided such that it has the predetermined and intended shape when the elastic strap band (3) is stretched at the predetermined stretching factor when wrapped around the front cover (1) for keeping the book (6) closed, and if the elastic strap band (3) is released from the front cover portion (1) for opening the cover, the elastic strap band (3) contracts and the image (4) disposed on the elastic strap band (3) is compressed and has a shape that is different and distorted from the predetermined, intended shape.

7. The cover according to claim 6, wherein the image (4) has at least a defined intended aspect ratio when the elastic strap band (3) is stretched at the predetermined stretching factor.

8. The cover according to claim 4, wherein the image (4) is applied to the elastic strap band (3) by at least one of being woven into the elastic strap band (3) or being printed onto the elastic strap band.

9. The cover according to claim 4, wherein the image (4) is applied to the elastic strap band (3) while the elastic strap band (3) is kept stretched at the predetermined stretching factor.

10. The cover according to claim 4, wherein the image (4) comprises a picture, a text message or a logo comprising a picture and a text message.

11. A book comprising a cover according to claim 1.

12. The cover according to claim 1, wherein the slit, except for an area associated with the gap, is completely enclosed by the top portion and the bottom portion of the movable member.

13. The cover according to claim 1, wherein the elastic strap band (3) is wrapped around the front cover portion (1) substantially horizontally or substantially vertically relative to a length of the cover portion.

14. The cover according to claim 1, wherein the cover is that of a book, a notebook, a calendar, a Filofax, a paper document, or a writing pad.

15. The cover according to claim 14, wherein the cover is a book and the book is one or more of a hard-bound book, an adhesive-bound book, a comb-bound book, or a ring-bound book.

* * * * *